US012419415B2

(12) United States Patent
Reppert et al.

(10) Patent No.: US 12,419,415 B2
(45) Date of Patent: Sep. 23, 2025

(54) ATTACHMENT DEVICE FOR SECURING A SHELF TO A SHELVING UNIT

(71) Applicant: InterMetro Industries Corporation, Wilkes-Barre, PA (US)

(72) Inventors: David A Reppert, Kingston, PA (US); Jeffrey C. Olson, Dallas, PA (US); Brock Romantic, Larksville, PA (US)

(73) Assignee: InterMetro Industries Corporation, Wilkes-Barre, PA (US)

( * ) Notice: Subject to any disclaimer, the term of this patent is extended or adjusted under 35 U.S.C. 154(b) by 0 days.

(21) Appl. No.: 18/415,037

(22) Filed: Jan. 17, 2024

(65) Prior Publication Data

US 2024/0251943 A1 Aug. 1, 2024

Related U.S. Application Data

(60) Provisional application No. 63/442,320, filed on Jan. 31, 2023.

(51) Int. Cl.
*A47B 57/40* (2006.01)
*A47B 47/00* (2006.01)
(Continued)

(52) U.S. Cl.
CPC ..... *A47B 57/40* (2013.01); *A47B 47/0083* (2013.01); *A47B 57/34* (2013.01); *A47B 57/583* (2013.01)

(58) Field of Classification Search
CPC ..... A47B 57/40; A47B 57/583; A47B 57/08; A47B 57/10; A47B 57/26; A47B 47/0083;
(Continued)

(56) References Cited

U.S. PATENT DOCUMENTS 3,424,111 A 1/1969 Maslow
4,237,798 A 12/1980 Welsch et al.
(Continued)

FOREIGN PATENT DOCUMENTS

EP 4410152 A1 * 8/2024 ..... A47B 57/34
JP 2007175224 A 7/2007

OTHER PUBLICATIONS

Nimble Innovate the ordinary-Catalogue Nimble-Catalogue.pdf (nimbleequipment.com) (circa. Jan. 25, 2017) <https://www.nimbleequipment.com/wp-content/uploads/Nimble-Catalogue.pdf>.
(Continued)

*Primary Examiner* — Jennifer E. Novosad
(74) *Attorney, Agent, or Firm* — Harness, Dickey & Pierce, P.L.C.

(57) ABSTRACT

A shelving unit has a plurality of posts, a shelf, and a shelf attachment device. The shelf has corner edges that are coupled to the posts. The shelf attachment device is formed as a separate component from the posts and the shelf. The shelf attachment device is attachable to one of the plurality of posts, and detachable from the one of the plurality of posts. The shelf attachment device has a ledge that removably receives corner edges of the shelf. The shelf attachment device has a collar that extends around the one of the plurality of posts when the shelf attachment device is attached to the one of the plurality of posts. The shelf attachment device has a lock plate that is slidably engaged with the collar to secure the collar to one of the plurality of posts.

9 Claims, 23 Drawing Sheets

(51) Int. Cl.
*A47B 57/34* (2006.01)
*A47B 57/58* (2006.01)

(58) Field of Classification Search
CPC ..... A47B 57/30; A47B 57/32; A47B 57/34; A47B 57/402; A47B 57/54
USPC ..... 211/187, 189
See application file for complete search history.

(56) References Cited

U.S. PATENT DOCUMENTS 4,750,626 A * 6/1988 Nicely ..... A47B 57/265 211/187
4,892,044 A 1/1990 Welsch
5,002,247 A 3/1991 Dispenza et al.
5,695,078 A * 12/1997 Otema ..... A47B 96/1416 211/187
5,941,399 A * 8/1999 Wang ..... A47B 57/54 211/187
5,960,968 A * 10/1999 Wang ..... A47B 17/03 211/187
6,015,052 A * 1/2000 Goldberg ..... A47B 57/545 108/106
6,044,988 A * 4/2000 Yang ..... A47B 57/265 211/187
6,068,143 A * 5/2000 Wang ..... A47B 57/265 211/187
6,113,042 A * 9/2000 Welsch ..... A47B 57/265 211/187
6,253,933 B1 * 7/2001 Yang ..... A47B 57/545 211/187
6,302,284 B1 * 10/2001 Zonshin ..... A47B 47/0083 108/147.11
7,059,484 B1 * 6/2006 Goldberg ..... A47B 47/0083 211/187
7,401,754 B2 * 7/2008 Welch ..... A47B 57/545 211/187
7,478,971 B2 * 1/2009 Li ..... A47B 57/562 403/398
7,568,436 B2 8/2009 McAllister et al.
7,992,731 B2 * 8/2011 Mcallister ..... A47B 57/545 211/187
9,167,915 B1 * 10/2015 Lau ..... A47B 57/545
9,314,098 B2 * 4/2016 Sabounjian ..... A47B 57/545
10,058,174 B1 * 8/2018 Tang ..... A47B 57/545
11,330,902 B2 * 5/2022 Woo ..... A47B 96/14
2017/0065078 A1 * 3/2017 Sabounjian ..... A47B 57/265
2017/0224106 A1 * 8/2017 Sabounjian ..... A47B 47/0083
2024/0251943 A1 * 8/2024 Reppert ..... A47B 57/545

OTHER PUBLICATIONS

Search Report regarding European Patent Application No. 241548577, dated Jun. 24, 2024.

* cited by examiner

ATTACHMENT DEVICE FOR SECURING A SHELF TO A SHELVING UNIT

CROSS-REFERENCE TO RELATED APPLICATION

This application claims the benefit of U.S. Provisional Application No. 63/442,320, filed on Jan. 31, 2023. The entire disclosures of the above applications are incorporated herein by reference.

FIELD

The present disclosure relates to an attachment device to secure a shelf to a shelving unit.

BACKGROUND

This section provides background information related to the present disclosure which is not necessarily prior art.

Shelving units are used to store items in an organized manner. Shelving units may include a plurality of posts and a plurality of shelves attached to each post. A plurality of receivers may be disposed at each corner of each of the shelves. Each of the receivers may receive one of the posts and thereby, secure one of the shelves to the post.

In one example, an upper shelf may be positioned near a top end of the plurality of posts and a lower shelf may be positioned near a bottom end of the plurality of posts. To add a new shelf that is positioned between the upper and lower shelves, a user is often required to move the upper shelf to a lower position. This involves the user to remove all of the items that are stored on the upper shelf and slide the upper shelf downward. Subsequently, the user may add the new shelf by sliding the new shelf down the plurality of posts from a position above the top end to the previous location of the upper shelf. In other words, the user must align the new shelf with the top end of the plurality of posts and slide the new shelf down the plurality of posts. The user is not able to add the new shelf to the plurality of posts from a position beside the plurality of posts or from a position between the upper end and lower ends. After the new shelf is added, the user re-adds the items that were previously stored on the upper shelf and adds new items to the new shelf.

As shown, it is cumbersome, time consuming, and inefficient to add and remove shelves from current shelving units since adding and removing shelves involve moving at least one of the existing shelves of the shelving unit. In light of these challenges, efficient solutions to add and remove shelves from shelving units are needed.

SUMMARY

This section provides a general summary of the disclosure, and is not a comprehensive disclosure of its full scope or all of its features.

The present disclosure provides a shelf attachment device that enables a user to efficiently and easily add and remove shelves from a shelving unit. One shelf attachment device is coupled to each post of the shelving unit. The shelf attachment device includes a collar and a locking plate. To add a shelf, the collar is opened and wrapped around the post. The locking plate slides over a portion of the collar to secure the collar in the closed position. A ledge of the shelf attachment device holds a corner edge of the shelf. Once all attachment devices are secured to the posts of the shelving unit, the corner edges of the shelf are positioned on the ledges of the attachment device and thereby, adds the shelf to the shelving unit.

The shelf attachment devices allow a user to add and remove a shelf in between pre-existing shelves of the shelving unit without modifying the position of the pre-existing shelves and/or removing items stored on the pre-existing shelves. Additionally, the shelf attachment devices allow the user to easily swap the shelf with another shelf, or another type of shelf. Also, the shelf may be locked in place on the shelf attachment device.

In some aspects, the present disclosure provides a shelving unit including a plurality of posts, a shelf, and a shelf attachment device. The plurality of posts each extend between a first post end and a second post end that opposes the first post end. The shelf includes corner edges that are coupled to the plurality of posts and positioned between the first post end and the second post end. The shelf attachment device is formed as a separate component from the plurality of posts and the shelf. The shelf attachment device is attachable to one of the plurality of posts, and detachable from the one of the plurality of posts. The shelf attachment device includes a ledge and one of the corner edges is removably placed on the ledge. The shelf attachment device includes a collar that extends around the one of the plurality of posts when the shelf attachment device is attached to the one of the plurality of posts. The shelf attachment device includes a lock plate that is slidably coupled with the collar to secure the collar to the one of the plurality of posts.

In some configurations of the shelving unit of the above paragraph, the collar includes a body that extends between a first body end and a second body end that opposes the first body end.

In some configurations of the shelving unit of either of the above paragraphs, the body includes a slit that extends between the first and second body ends.

In some configurations of the shelving unit of any of the above paragraphs, the body is made of a flexible material and is movable between an open position and a closed position.

In some configurations of the shelving unit of any of the above paragraphs, the collar includes a pair of wing-like extensions that extend tangentially from the body.

In some configurations of the shelving unit of any of the above paragraphs, the pair of wing-like extensions are disposed on opposing sides of the slit and extend in opposing directions.

In some configurations of the shelving unit of any of the above paragraphs, movement of the pair of wing-like extensions in a direction toward each other places the collar in a closed position. Movement of the pair of wing-like extensions in a direction away from each other places the collar in an open position.

In some configurations of the shelving unit of any of the above paragraphs, the lock plate includes a pair of receivers that are slidably engaged with the pair of wing-like extensions of the collar.

In some configurations of the shelving unit of any of the above paragraphs, the lock plate includes the ledge.

In some configurations of the shelving unit of any of the above paragraphs, the collar includes the ledge.

The present disclosure also provides a shelf attachment device that is configured to secure a shelf to a post of a shelving unit. The shelf attachment device includes a collar and a lock plate. The collar includes a body that extends around the post and a pair of wing-like extensions that extend away from the body. The body extends longitudinally between a first body end and a second body end that opposes the first body end. The body moves between an open position and a closed position. The lock plate includes a pair of receivers that is slidably engaged with the pair of wing-like extensions to secure the collar in the closed position and a ledge that is configured to hold at least one of a corner edge of the shelf and a siderail of the shelf.

In some configurations of the shelf attachment device of the above paragraph, the collar includes a first half and a second half. The first and second halves are separated in the open position and the first and second halves are interlocked together in the closed position.

In some configurations of the shelf attachment device of either of the above paragraphs, the body includes a slit that extends between the first body end and the second body end and allows the collar to move between the open position and the closed position.

In some configurations of the shelf attachment device of any of the above paragraphs, the pair of wing-like extensions each extend tangentially away from the body in opposite directions from each other.

In some configurations of the shelf attachment device of any of the above paragraphs, the pair of wing-like extensions are positioned on opposing sides of the slit.

In some configurations of the shelf attachment device of any of the above paragraphs, each of the pair of wing-like extensions of the collar tapers such that a first width of the pair of wing-like extensions at the first body end is less than a second width of the pair of wing-like extensions at the second body end.

In some configurations of the shelf attachment device of any of the above paragraphs, the lock plate extends between a first plate end and a second plate end that opposes the first plate end. The pair of receivers extend between the first plate end and the second plate end. Each of the pair of receivers taper such that a first plate width of the pair of receivers at the first plate end is less than a second plate width of the pair of receivers at the second plate end.

In some configurations of the shelf attachment device of any of the above paragraphs, the shelf attachment device includes a second pair of wing-like extensions and a second lock plate. The second pair of wing-like extensions extends from the body and is positioned opposite to the pair of wing-like extensions. The second lock plate includes a pair of second receivers that is slidably engaged with the second pair of wing-like extensions.

In some configurations of the shelf attachment device of any of the above paragraphs, the second lock plate includes a second ledge that is configured to hold a second corner edge of a second shelf of the shelving unit.

The present disclosure also provides a shelf attachment device that is configured to secure a shelf to a shelving unit. The shelf attachment device includes a collar having a body, pair of wing-like extensions, an annular protrusion, a lock plate having a base plate, a pair of receivers and a ledge. The body of the collar extends between a first body end and a second body end that opposes the first body end. It includes an interior surface and an exterior surface that opposes the interior surface. The body includes a slit that extends between the first and second body ends and allows the collar to move between an open position and a closed position. The pair of wing-like extensions of the collar extends away from the exterior surface of the body and is positioned on opposing sides of the slit. The annular protrusion of the collar is disposed on the interior surface of the body and extends annularly about the body. The base plate of the lock plate extends longitudinally between a first plate end and a second plate end that opposes the first plate end and extends laterally between a third plate end and a fourth plate end that opposes the third plate end. The pair of receivers of the lock plate is disposed at the third and fourth plate ends, extends between the first and second plate ends, and is slidably engaged with the pair of wing-like extensions. The ledge is disposed at the first plate end, includes a first wall attached to the base plate and a second wall that extends from the first wall to substantially form an L-shape, and is configured to hold the shelf of the shelving unit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The present disclosure provides a shelf attachment device that allows a user to efficiently add and remove shelves from a shelving unit, without modifying the position of pre-existing shelves of the shelfing unit. One shelf attachment device is coupled to each post of the shelving unit. To add a shelf, the shelf attachment device includes a collar and a locking plate. The collar is opened and wrapped around the post. The locking plate slides over a portion of the collar to secure the collar to the post. A ledge of the shelf attachment device is configured to hold a corner edge of the shelf. Once the attachment devices are secured to the posts of the shelving unit, the corner edges of the shelf are placed on the ledges of the shelf attachment device and thereby, the shelf is added to the shelving unit. Advantageously, the shelf attachment device provides an easy solution to adding shelves, removing shelves, and even swapping shelves of the shelving unit.

Figure 1:
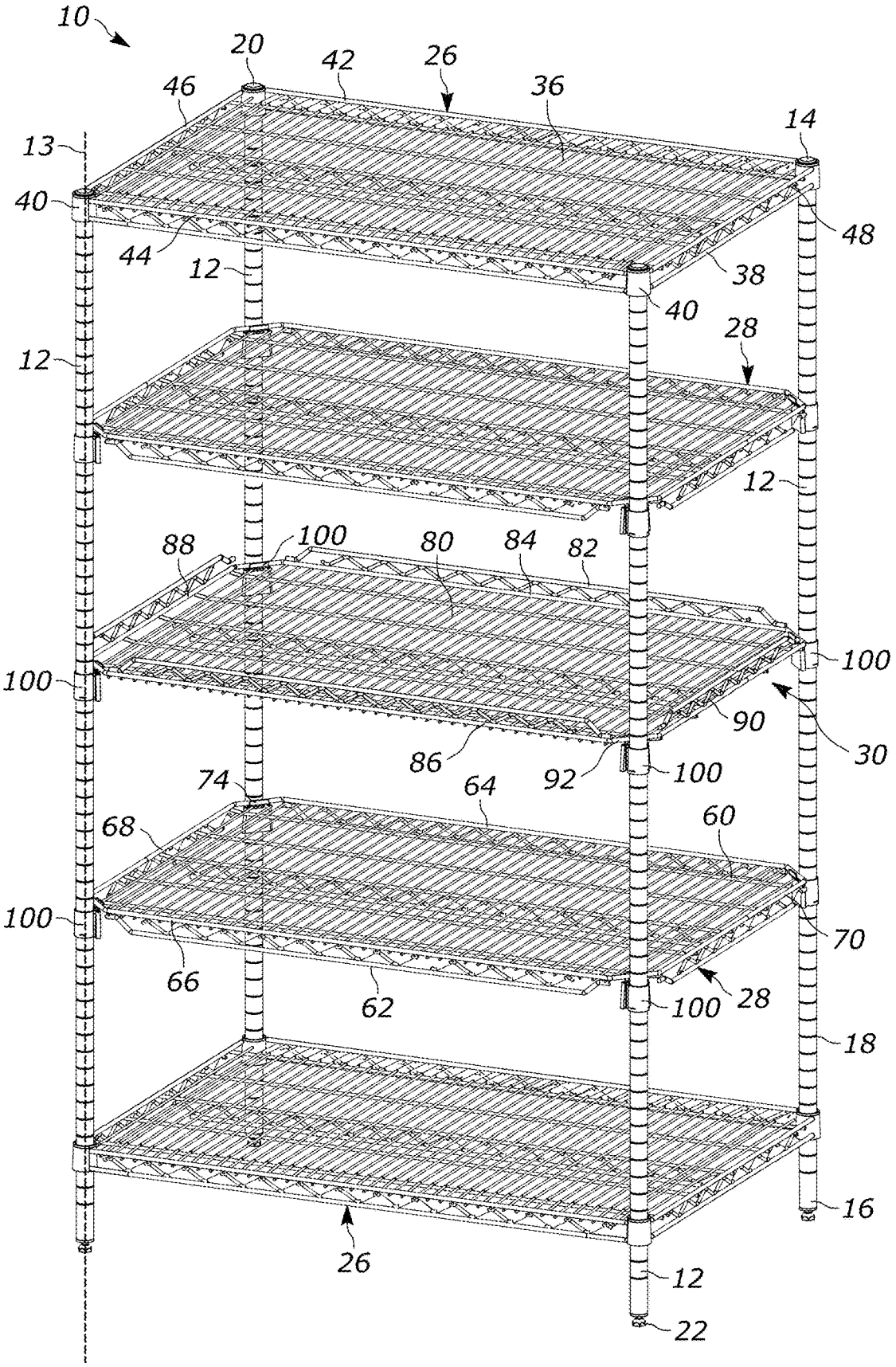
FIG. 1 is a perspective view of a shelving unit constructed in accordance with the present disclosure.
Figure 2:
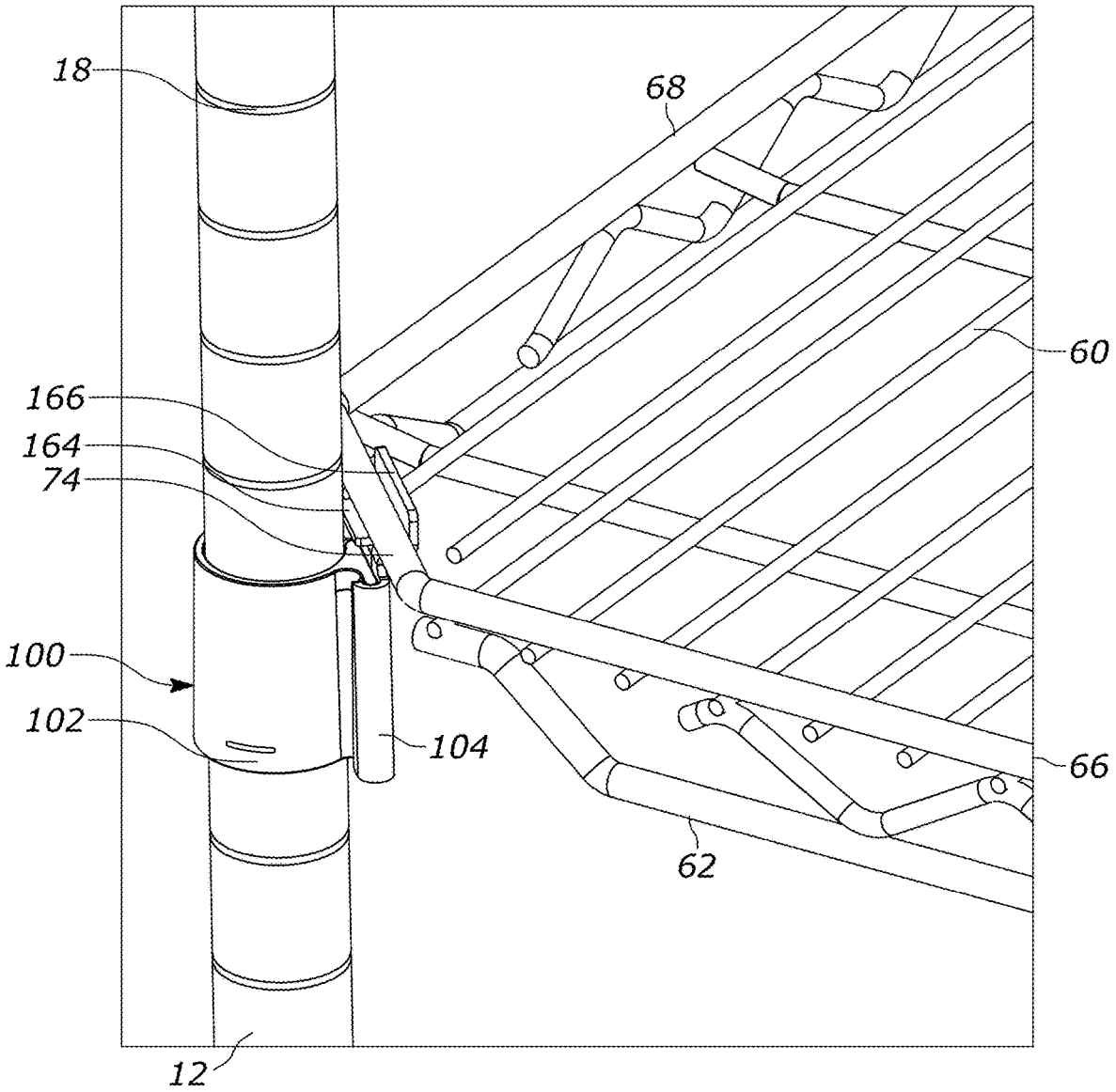
FIG. 2 is a perspective view of a shelf attachment device of the shelving unit shown in FIG. 1.

With reference to FIGS. 1-2, a shelving unit 10 according to the present disclosure is described. The shelving unit 10 may include a plurality of vertically oriented support posts 12. In the illustrated example, the plurality of posts 12 include four posts that are arranged in a parallelogram shape (and, more specifically, a rectangle) when viewed from above the shelving unit 10. However, another suitable number of posts 12 may be used and the posts 12 may be arranged in another suitable configuration, such as three posts 12 arranged in a triangular shape.

Each post 12 extends along a longitudinal axis 13 between a first post end 14 and a second post end 16 that opposes the first post end 14. Each post 12 may be substantially formed in a cylindrical shape or another suitable shape. Each post 12 includes a plurality of circumferential indents or grooves 18 that are spaced apart along the longitudinal axis 13 between the first and second post ends 14, 16. For example, the plurality of indents 18 may be spaced apart equidistantly along the longitudinal axis 13 by about 1 inch from each other. A cap 20 may be disposed at the first post end 14 of each of the posts 12. A base 22 may be disposed at the second post end 16 of each of the posts 12. The base 22 may contact a ground surface and support the shelving unit 10. In some examples, the base 22 may be movable relative to the respective post 12 toward the second post end 16 and away from the second post end 16. Moving one or more bases 22 of the posts 12 allows the shelving unit 10 to be leveled relative to the ground surface. In some configurations, a wheel (e.g., wheel 1622) may be disposed at the second post end 16 of each of the plurality of posts 12. The wheels allow the shelving unit 10 to move relative to the ground surface, for example, to transport the shelving unit 10 to another location.

The shelving unit 10 may include one or more first shelves 26, one or more second shelves 28, one or more third shelves 30, or a combination thereof. In one example, the shelving unit 10 may include first shelves 26 and second shelves 28. In another example, the shelving unit 10 may include first shelves 26 and third shelves 30. In another example, the shelving unit 10 may include second shelves 28 and third shelves 30. In yet another example, as illustrated, the shelving unit 10 may include first shelves 26, second shelves 28, and third shelves 30. The first, second, and third shelves 26, 28, 30 are secured to each of the posts 12 and are used to store items within the shelving unit 10.

The first shelves 26 are positioned between the first and second post ends 14, 16. In the illustrated example, the shelving unit 10 includes two first shelves 26. A first one of the first shelves 26 is positioned near or at the first post end 14 and a second one of the first shelves 26 is positioned near or at the second post end 16. However, the shelving unit 10 may include another suitable number of first shelves 26 and the first shelves 26 may be positioned at another suitable position along the posts 12. For example, the shelving unit 10 may include an additional first shelf that is positioned about equidistantly between the first post end 14 and the second post end 16.

The first shelves 26 may include a first shelf platform 36, a first siderail 38, and a plurality of receivers 40. The first shelf platform 36 may be made of a metal material, a plastic material or another suitable material. The first shelf platform 36 may be formed as a wire grate, a basket, or another suitable configuration. In the illustrated example, the first shelf platform 36 extends longitudinally between a first side 42 and a second side 44 that opposes the first side 42 and extends laterally between a third side 46 and a fourth side 48 that opposes the third side 46. The first, second, third, and fourth sides 42, 44, 46, 48 cooperate to form a parallelogram shape with four corners. However, the first shelf platform 36 may include another suitable number of sides and may be formed in another suitable shape, such as three sides configured in a triangular shape when the plurality of posts 12 include three posts.

The first siderail 38 extends from the first shelf platform 36. The first siderail 38 extends from the first side 42, the second side 44, the third side, 46 the fourth side 48, or a combination thereof. In the illustrated example, the first siderail 38 extends from each of the first, second, third and fourth sides 42, 44, 46, 48. The first siderail 38 extend in a substantially downward direction (e.g., a direction from the first post end 14 to the second post end 16). In another example, the first siderails 38 may extend in a substantially upward direction (e.g., a direction from the second post end 16 to the first post end 14).

Each of the receivers 40 is positioned at the corners of the first shelf platform 36, or at another suitable location of the first shelf platform 36. A first one of the receivers 40 is disposed at an intersection (i.e., corner) of the first and third sides 42, 46 of the first shelf platform 36. A second one of the receivers 40 is disposed at an intersection of the second and third sides 44, 46 of the first shelf platform 36. A third one of the receivers 40 is disposed at an intersection of the first and fourth sides 42, 48 of the first shelf platform 36. A fourth one of the receivers 40 is disposed at an intersection of the second and fourth sides 44, 48 of the first shelf platform 36. Accordingly, the first shelf 26 of the illustrated example includes four receivers 40. However, another suitable number of receivers 40 may be provided that is equal to the number of posts 12 provided in the plurality of posts 12.

Each of the plurality of receivers 40 receives one of the posts 12. The receivers 40 may have a cross-sectional shape and size to contour the cross-sectional shape and size of the posts 12. The plurality of receivers 40 are axially aligned with the respective posts 12 and are movable along the respective post 12 between the first post end 14 and the second post end 16. Each of the plurality of receivers 40 of one first shelf 26 may be positioned at the same or similar position along the respective posts 12.

The second shelves 28 are positioned between the first and second post ends 14, 16 and may be positioned between the first shelves 26. In the illustrated example, the shelving unit 10 includes two second shelves 28. A first one of the second shelves 28 is positioned near the first post end 14. The first one of the second shelves 28 is positioned below the first one of the first shelf 26. A second one of the second shelves 28 is positioned near the second post end 16. The second one of the second shelves 28 is positioned below the second one of the first shelves 26. However, the shelving unit 10 may include another suitable number of second shelves 28 and the second shelves 28 may be positioned at another suitable position along the posts 12.

The second shelf 28 may include a second shelf platform 60 and a second siderail 62. The second shelf platform 60 may be made of a metal material, a plastic material, or another suitable material. The second shelf platform 60 may be formed as a wire grate, a basket, or another suitable configuration. The second shelf platform 60 extends between a first side 64 and a second side 66 that opposes the first side 64 and extends between a third side 68 and a fourth side 70 that opposes the third side 68. The first, second, third, and fourth sides 64, 66, 68, 70 cooperate to form a parallelogram shape with four corners. However, the second shelf platform 60 may have another suitable number of sides configured in another suitable arrangement.

The second shelf platform 60 may include a corner edge 74 disposed at each of the corners. A first one of the corner edges 74 is disposed at an intersection of the first and third sides 64, 68 of the second shelf platform 60. A second one of the corner edges 74 is disposed at an intersection of the second and third sides 66, 68 of the second shelf platform 60. A third one of the corner edges 74 is disposed at an intersection of the first and fourth sides 64, 70 of the second shelf platform 60. A fourth one of the corner edges 74 is disposed at an intersection of the second and fourth sides 66, 70 of the second shelf platform 60. Each of the corner edges 74 are positioned inboard of the post 12. Each of the corner edges 74 is positioned at an obtuse angle relative to the adjacent sides to form a slanted corner. In some configurations, adjacent sides of the second shelf platform 60 are directly attached to each other in a perpendicular manner.

The second siderail 62 may extend from the first side 64, the second side 66, the third side 68, the fourth side 70, or a combination thereof. In the illustrated example, the second siderail 62 extends from each of the first, second, third, and fourth sides 64, 66, 68, 70 of the second shelf platform 60. The second siderail 62 extends substantially in the downward direction.

The third shelves 30 are positioned between the first and second post ends 14, 16. The third shelves 30 may be positioned between the first shelves 26, between the second shelves 28, or a combination thereof. In the illustrated example, the shelving unit 10 includes one third shelf 30. The third shelf 30 is positioned between the second shelves 28 and disposed about equidistantly between the first and second post ends 14, 16 of the posts 12. However, the shelving unit 10 may include another suitable number of third shelves 30 and the third shelves 30 may be positioned at another suitable position along the posts 12.

The third shelf 30 may include a third shelf platform 80 and a third siderail 82. The third shelf platform 80 is the same or substantially similar to the second shelf platform 60. Accordingly, the third shelf platform 80 will not be re-described in detail.

The third shelf platform 80 includes a first side 84, a second side 86, a third side 88, and a fourth side 90 with corner edges 92. In some configurations, the third shelf platform 80 may be positioned at an angle relative to the first shelf platform 36 of the first shelf 26. In one example, the first side 84 of the third shelf platform 80 may be positioned closer to the first post end 14 by a distance, as compared to the second side 86 of the third shelf platform 80. In another example, the second side 86 of the third shelf platform 80 may be positioned closer to the first post end 14 by the distance, as compared to the first side 84 of the third shelf platform 80. In yet another example, the third side 88 of the third shelf platform 80 may be positioned closer to the first post end 14 by the distance, as compared to the fourth side 90 of the third shelf platform 80. In yet another example, the fourth side 90 of the third shelf platform 80 may be positioned closer to the first post end 14 by the distance, as compared to the third side 88 of the third shelf platform 80. The distance may be about 3 inches, or another suitable distance.

The third siderail 82 extends from the first side 84, the second side 86, the third side 88, the fourth side 90 of the third shelf platform 80, or a combination thereof. In the illustrated example, the third siderail 82 extends from each of the first, second, third, and fourth sides 84, 86, 88, 90. The third siderail 82 extends substantially in the upward direction from the third shelf platform 80. The third siderail 82 retains the items stored on the third shelf platform 80 from sliding off the third shelf platform 80 when the third shelf platform 80 is positioned at an angle relative to the ground surface.

Figure 3:
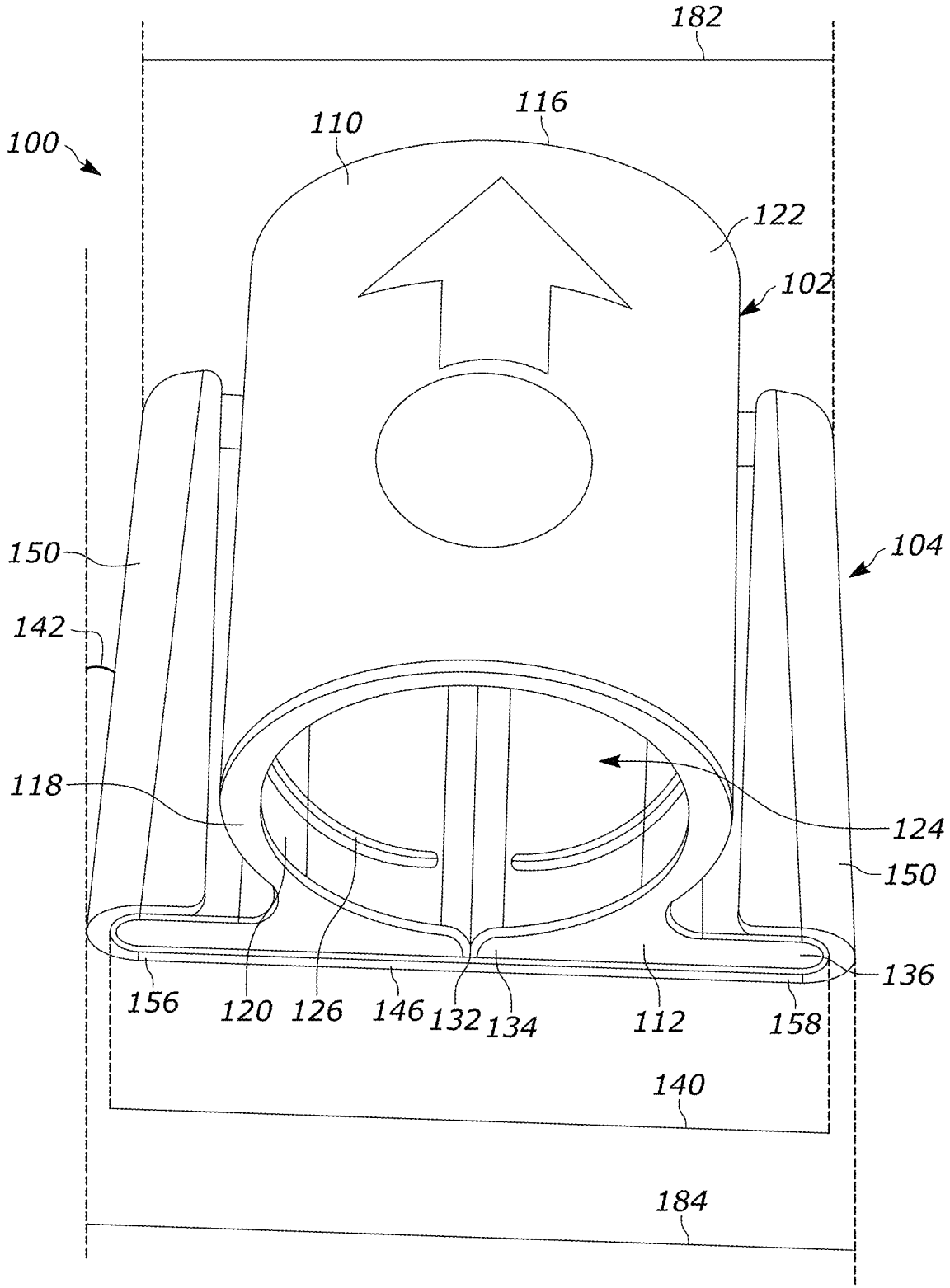
FIG. 3 is a perspective view of the shelf attachment device shown in FIGS. 1-2.
Figure 4:
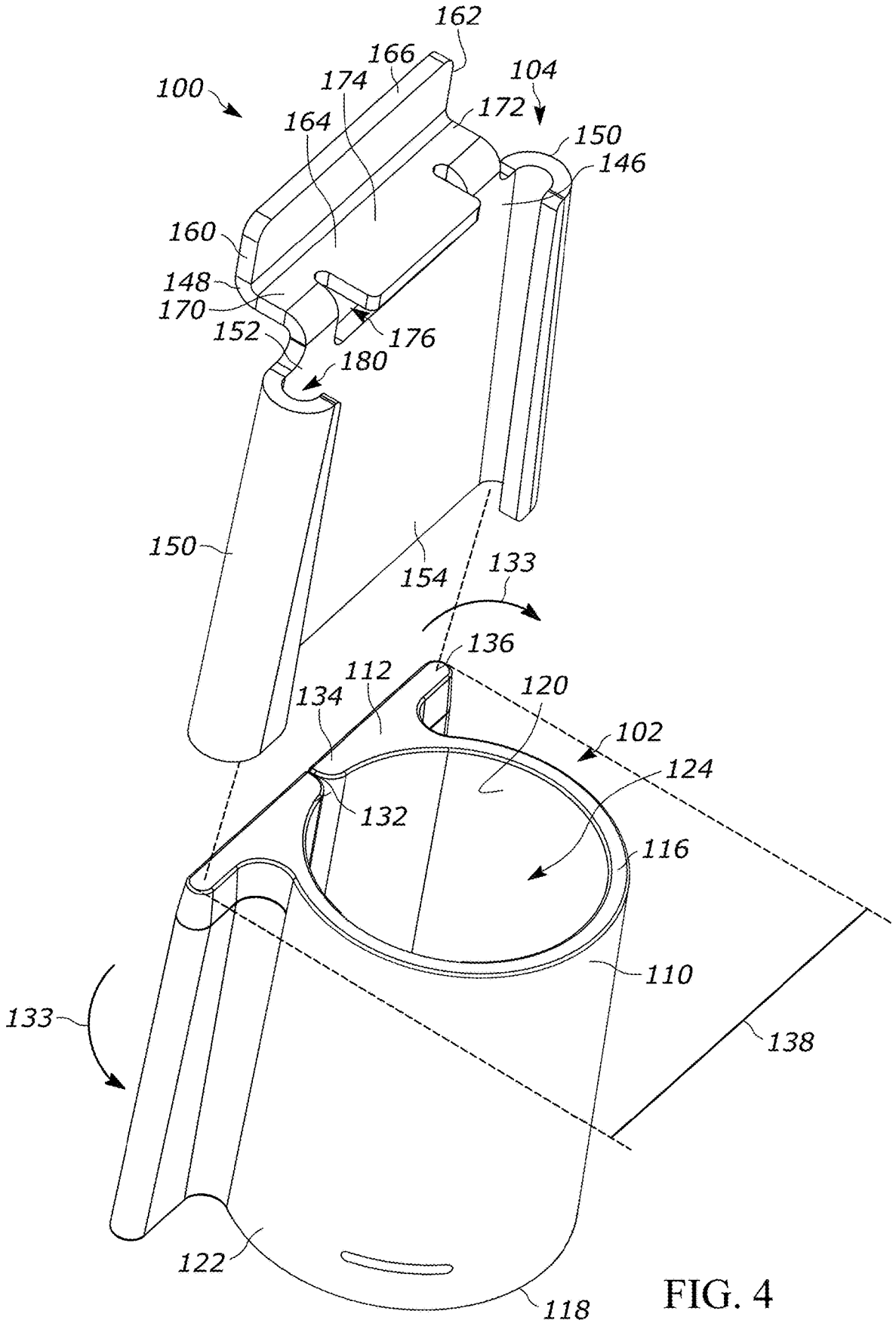
FIG. 4 is an exploded view of the shelf attachment device shown in FIGS. 1-3.

With additional reference to FIGS. 3-4, the second and third shelves 28, 30 are attached to each post 12 using a shelf attachment device 100 according to the present disclosure. The shelf attachment device 100 includes a collar 102 and a lock plate 104. The collar 102 is movable between an open position and a closed position. As will be described in greater detail below, the collar 102 is flexed to the open position to receive one of the posts 12 and subsequently, the lock plate 104 is slidably engaged with the collar 102 to secure the shelf attachment device 100 to the post 12.

The collar 102 includes a body 110 and a pair of wing-like extensions 112 that extend from the body 110. The body 110 is shaped and sized to contour the cross-sectional shape and size of the post 12. The body 110 extends between a first body end 116 and a second body end 118 that opposes the first body end 116. The body 110 includes an interior surface 120 and an exterior surface 122 that opposes the interior surface 120. The interior surface 120 defines an opening 124 that extends between the first and second body ends 116, 118. An annular protrusion or rib 126 may protrude from the interior surface 120 and may be positioned adjacent to the second body end 118. The annular protrusion 126 extends radially inward into the opening 124 and extends annularly about the body 110. The annular protrusion 126 is shaped and sized to be positioned within one indent 18 of the post 12 in a slip-fit arrangement. A slit 132 extends through one side of the body 110 and extends between the first body end 116 and the second body end 118. The slit 132 divides the collar 102 into two halves. The collar 102 is flexible between the open position and the closed position. To move to the open position, the two halves flex away from one another in a direction 133 and thereby, provides lateral access to the opening 124. To move to the closed position, the two halves rebound toward one another and close lateral access to the opening 124. The body 110 is made of a material that is flexible and resilient, such as nylon or another suitable material. In one example, the nylon is 30% glass-filled nylon. In another example, the nylon is unfilled nylon. The material allows the collar 102 to repeatedly move between the open and closed positions.

The pair of wing-like extensions 112 are disposed on opposing sides of the slit 132 and extend tangentially away from the body 110 in opposite directions. The pair of wing-like extensions 112 extend between the first and second body ends 116, 118 of the body 110. Additionally, each of the pair of wing-like extensions 112 extend between an inner wing end 134 and an outer wing end 136 that opposes the inner wing end 134. When the shelf attachment device 100 is in the open position, the inner wing ends 134 of the pair of wing-like extensions 112 are spaced apart from each other. When the shelf attachment device 100 is in the closed position, the inner wing ends 134 of the pair of wing-like extensions 112 abut each other. The pair of wing-like extensions 112 are each tapered between the first and second body ends 116, 118. More specifically, the pair of wing-like extensions 112 collectively have a first width 138 at the first body end 116 and a second width 140 at the second body end 118. The first and second widths 138, 140 are measured between the outer wing ends 136. The second width 140 is larger than the first width 138. The pair of wing-like extensions 112 are tapered at an acute angle 142. In one example, the acute angle 142 ranges from about 2 degrees to about 15 degrees. In another example, the acute angle 142 is about 5 degrees. The pair of wing-like extensions 112 are molded with the body 110 such that the body 110 and the pair of wing-like extensions 112 are one component. Alternatively, the pair of wing-like extensions 112 may be a separate component from the body 110 and attached to the body 110.

The lock plate 104 includes a base plate 146, a ledge 148, and a pair of receivers 150. The base plate 146 extends longitudinally between a first plate end 152 and a second plate end 154 that opposes the first plate end 152. Additionally, the base plate 146 extends laterally between a third plate end 156 and a fourth plate end 158 that opposes the third plate end 156. When the lock plate 104 is disposed over the collar 102, the first plate end 152 is positioned adjacent to the first body end 116 of the collar 102. The second plate end 154 is positioned adjacent to the second body end 118 of the collar 102. The third and fourth plate ends 156, 158 are positioned adjacent to the pair of wing-like extensions 112 of the collar 102. The base plate 146 is substantially flat, however, may be formed in another suitable shape.

The ledge 148 of the lock plate 104 extends between a first ledge end 160 and a second ledge end 162 that opposes the first ledge end 160. The first ledge end 160 is positioned near the third plate end 156 of the base plate 146. The second ledge end 162 is positioned near the fourth plate end 158 of the base plate 146. The ledge 148 includes a first wall 164 and a second wall 166 that extends from the first wall 164. The first and second walls 164, 166 substantially form an L-shape. The first wall 164 is attached to the first plate end 152 and is positioned about perpendicular to the base plate 146 of the lock plate 104. The second wall 166 extends from the first wall 164 and is positioned about perpendicular to the first wall 164. The corner edges 74 of the second shelf 28 and the corner edges 92 of the third shelf 30 are supported by the ledge 148 when the shelf attachment device 100 holds the second shelf 28 and third shelf 30. As shown in FIG. 2, the corner edges 74, 92 rest on the first wall 164 of the ledge 148 and abuts the second wall 166 of the ledge 148.

The first wall 164 includes a first portion 170 disposed at the first ledge end 160, a second portion 172 disposed at the second ledge end 162, and a lip 174 disposed between the first and second portions 170, 172. The first portion 170 of the first wall 164 is attached to the base plate 146 at a position that is adjacent to the third plate end 156. The second portion 172 of the first wall 164 is attached to the base plate 146 at a position that is adjacent to the fourth plate end 158. The lip 174 is positioned about perpendicular to the second wall 166 of the ledge 148 and about perpendicular to the base plate 146. The lip 174 extends in a direction from the second wall 166 to above the slit 132 of the collar 102. An opening 176 is disposed between the lip 174 and the first plate end 152 of the base plate 146.

The pair of receivers 150 of the lock plate 104 are disposed at the third and fourth plate ends 156, 158. The pair of receivers 150 are in mirror-image configuration with each other. The receivers 150 extend between the first plate end 152 and the second plate end 154. The receivers 150 are configured to secure the collar 102 in the closed position. More specifically, each receiver 150 includes a cavity 180 that is shaped and sized to one of the pair of wing-like extensions 112. The pair of receivers 150 is slidably engaged with the pair of wing-like extensions 112 in a slip-fit configuration. In the illustrated example, the receiver 150 is formed in a C-shape and at least partially wraps around the outer wing end 136 of the wing-like extension 112 when the lock plate 104 is assembled with the collar 102. The receiver 150 is tapered at the acute angle 142 to match the taper of the pair of wing-like extensions 112. More specifically, the lock plate 104 has a first plate width 182 at the first plate end 152 and a second plate width 184 at the second plate end 154. The first and second plate widths 182, 184 are measured between the pair of receivers 150 of the lock plate 104. The second plate width 184 is greater than the first plate width 182.

The shelf attachment devices 100 allow the second shelves 28 and the third shelves 30 to be added to the shelving unit 10 and removed from the shelving unit 10 without removing any of the other shelves (e.g., first shelves 26, second shelves 28, third shelves 30) previously attached to the shelving unit 10. The operation of the shelf attachment devices 100 for adding and removing a shelf is the same or substantially similar for the second shelf 28 and the third shelf 30. Though the following description references the second shelf 28, the same operation also applies to the third shelf 30.

To add the second shelf 28 to the shelving unit 10, the collar 102 of the shelf attachment device 100 is moved from the closed position to the open position by opening the slit 132. In one example, the slit 132 may be opened by pulling apart the pair of wing-like extensions 112 of the collar 102 in the direction 133. From a location beside one of the post 12, the collar 102 is pressed into the respective post 12. The collar 102 is subsequently returned to the closed position and wraps around the post 12. The collar 102 may be moved to another selected location by moving the collar 102 vertically along the post 12 and the collar 102 may be rotated relative to the post 12. In one example, the collar 102 may be rotated relative to the post 12 to orient the wing-like extensions 112 to an inboard position relative to the shelving unit 10, as shown in FIG. 2.

The lock plate 104 is slidably engaged with the collar 102. The second plate end 154 of the lock plate 104 contacts the first body end 116 of the collar 102. The pair of receivers 150 are aligned with the pair of wing-like extensions 112. The lock plate 104 is subsequently moved in the downward direction until the first plate end 152 of the lock plate 104 is positioned adjacent to the first body end 116 of the collar 102. Accordingly, the lock plate 104 secures the collar 102 in the closed position. Because the wing-like extensions 112 of the post 12 are oriented in the inboard position of the shelving unit 10, the ledge 148 of the lock plate 104 is also oriented in a corresponding position to receive the corner edge 74 of the second shelf 28. After all four shelf attachment devices 100 are secured to the respective post 12, the corner edges 74 of the second shelf 28 may be positioned on top of the first wall 164 of the ledge 148 of the respective shelf attachment device 100. Thereby, the second shelf 28 is added to the shelving unit 10.

To remove the second shelf 28 from the shelving unit 10, the second shelf 28 is lifted from the ledges 148 of the shelf attachment devices 100. To remove the shelf attachment devices 100, the lock plate 104 is slidably removed from the collar 102. More specifically, the lock plate 104 is slidably moved in the upward direction such that the second plate end 154 of the lock plate 104 moves from a position adjacent to the second body end 118 of the collar 102 to a position adjacent to the first body end 116 of the collar 102. Subsequently, the collar 102 is moved from the closed position to the open position. The collar 102 is pulled away from the post 12 and then returned to the closed position. The same is repeated until all shelf attachment devices 100 that were used to hold the second shelf 28 are removed. Thereby, the second shelf 28 and the respective shelf attachment devices 100 are removed from the shelving unit 10.

Figure 5:
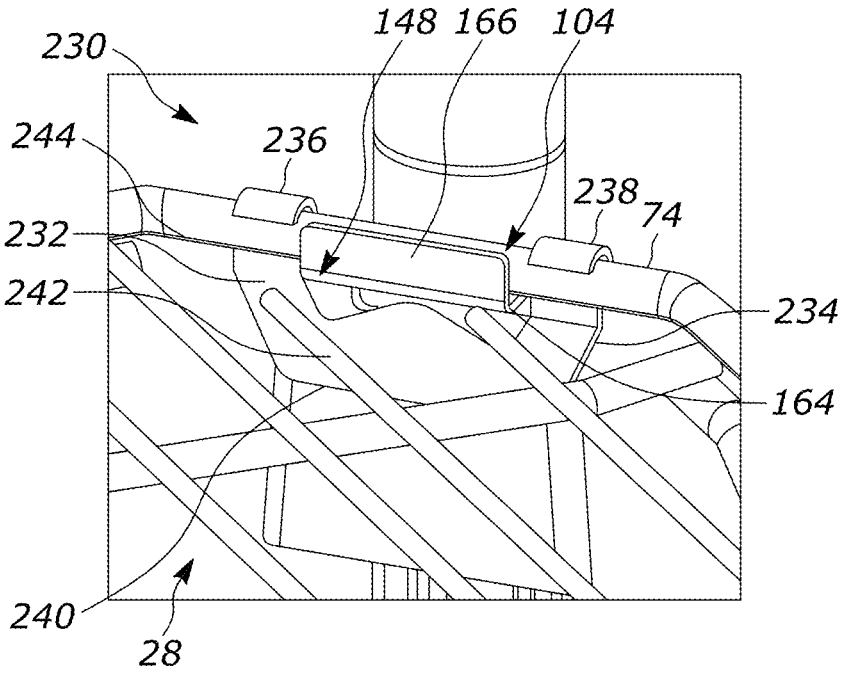
FIG. 5 is a perspective view of a lock clip that is operable to couple a shelf to the shelf attachment device.
Figure 6:
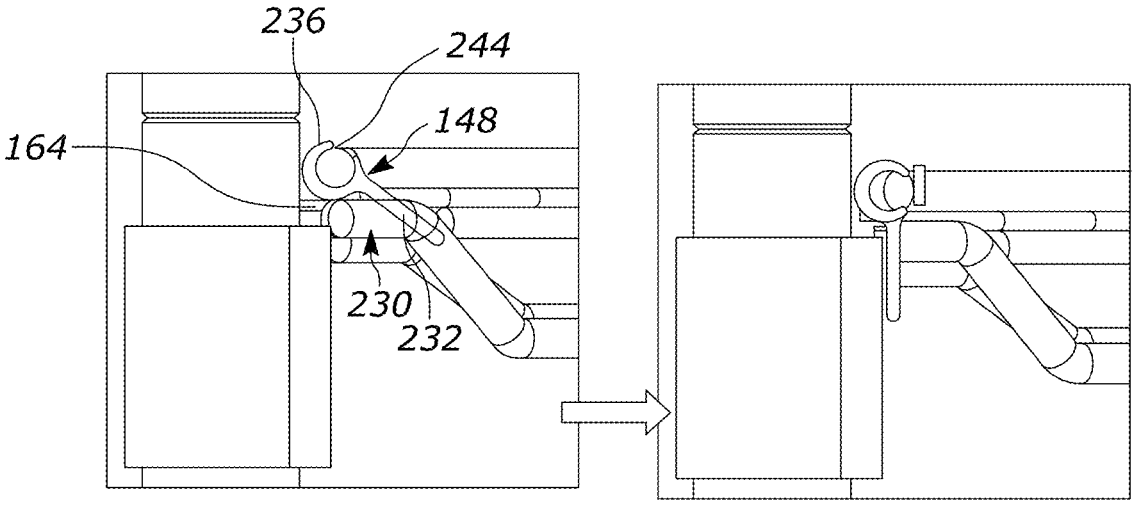
FIG. 6 is a side elevation view of FIG. 5

In FIGS. 5 and 6, a lock clip 230 is illustrated. The lock clip 230 has an overall U-shape configuration. The U-shape includes a pair of arms 232, 234 with barrels 236, 238 at the terminal end of each arm 232, 234. The web 240 defines a latch portion 242.

The barrels 236, 238 have a right cylindrical shape with a gap opening 244 along the axis of the barrels 236, 238. The opening 244 enables the lock clip 230 to be positioned onto the wire corner edge 74 as seen in FIG. 5. Thus, the lock clip 230 is enabled to rotate on the wire corner edge 74 between a locked and unlocked position as seen in FIGS. 5 and 6.

In the locked or down position, as illustrated in FIG. 5, the latch portion 242 of the web 240 is positioned under the ledge wall 164 of the lock plate 104. Thus, the shelf 28 is unable to be moved upward off of the ledge wall 164 when the lock clip 230 is in the locked or down position. For example, in the locked or down position, the lock clip 230 couples the shelf 28 to the shelf attachment device 100 and inhibits or prevents the shelf 28 from being separated from ledge 148 of the lock plate 104 of the shelf attachment device 100.

When the lock clip 230 is rotated (FIG. 6) from under the ledge wall 164, the shelf 28 can be removed from the lock plate ledge 148. The latch portion 242 may have a length such that it snaps under the ledge wall 164 and likewise snaps out of contact with the ledge wall 164 when it is rotated into its unlocked position.

Figure 7:
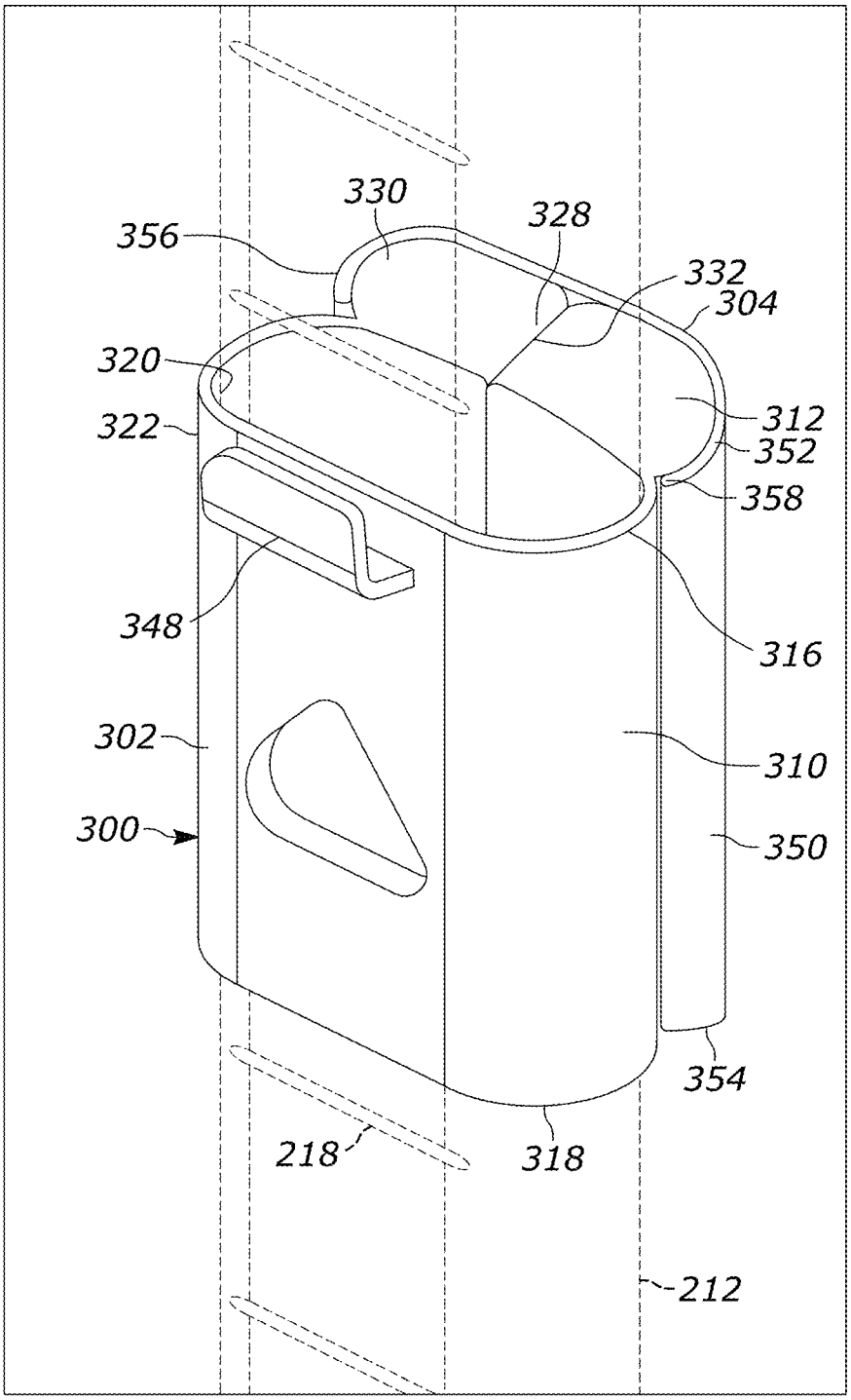
FIG. 7 is a perspective view of another shelf attachment device of a shelving unit constructed in accordance with the present disclosure.

With reference to FIG. 7, another example post 212 of a shelving unit (e.g., shelving unit 10) and another example shelf attachment device 300 are provided in accordance with the present disclosure. The shelf attachment device 300 is configured to attach a shelf (e.g., second shelf 28, third shelf 30) to the post 212.

The post 212 includes a plurality of grooves 218 that are longitudinally spaced apart. In the illustrated example, the post 212 has a cross-sectional shape that is non-circular. More specifically, the post 212 has an oblong cross-sectional shape. However, the post 212 may have another suitable cross-sectional shape. In one example, the post 212 may be the same or substantially similar to the post 12 of the shelving unit 10.

The shelf attachment device 300 includes a collar 302 and a lock plate 304. The collar 302 is movable between an open position and a closed position. The collar 302 may be moved into the open position to receive the post 212. When the collar 302 is in the closed position, the lock plate 304 is configured to slide into and out of engagement with the collar 302. The shelf attachment device 300 allows the shelf to be disassembled from the posts 212 by sliding the lock plate 304 out of engagement with the collar 302 and moving the collar 302 to the open position to remove the collar 302 from the post 212.

The collar 302 includes a body 310 and a pair of wing-like extensions 312 that extend from the body 310. The body 310 is shaped and sized to contour the cross-sectional shape and size of the post 212. The body 310 extends between a first body end 316 and a second body end 318 that opposes the first body end 316. The body 310 includes an interior surface 320 and an exterior surface 322 that opposes the interior surface 320. An annular protrusion or rib (e.g., annular protrusion 126) extends radially inward from the interior surface 320. The annular protrusion is shaped and sized to be positioned within one indent 218 of the post 212 in a slip-fit arrangement. A ledge 348 extends outwardly from the exterior surface 322 of the body 310. The ledge 348 may be disposed near the first body end 316. The ledge 348 substantially form an L-shape. The ledge 348 is configured to hold an edge of one of the shelves. A slit 332 extends through the body 310 and extends between the first body end 316 and the second body end 318. The body 310 is made of a material that is flexible and resilient, or another suitable material.

The pair of wing-like extensions 312 are disposed on opposing sides of the slit 332 and extend outwardly from the body 310. The pair of wing-like extensions 312 extend between the first and second body ends 316, 318. Additionally, each of the pair of wing-like extensions 312 extend between an inner wing end 328 and an outer wing end 330. When the body 310 is in the open position, the inner wing ends 328 of the pair of wing-like extensions 312 are spaced apart from each other. When the body 310 is in the closed position, the inner wing ends 328 of the pair of wing-like extensions 312 abut each other. The pair of wing-like extensions 312 are molded with the body 310 such that the body 310 and the pair of wing-like extensions 312 are one component. Alternatively, the pair of wing-like extensions 312 may be a separate component from the body 310 and attached to the body 310.

The lock plate 304 includes a pair of receivers 350 and extends longitudinally between a first plate end 352 and a second plate end 354 that opposes the first plate end 352. Additionally, the lock plate 304 extends laterally between a third plate end 356 and a fourth plate end 358 that opposes the third plate end 356. When the lock plate 304 is slidably engaged with the collar 302, the first plate end 352 is positioned adjacent to the first body end 316 of the collar 302, the second plate end 354 is positioned adjacent to the second body end 318 of the collar 302, and the third and fourth plate ends 356, 358 are positioned adjacent to the pair of wing-like extensions 312 of the collar 302.

The pair of receivers 350 are disposed at the third and fourth plate ends 356, 358, respectively. The pair of receivers 350 are configured in mirror-image with each other. Each of the pair of receivers 350 extend between the first and second plate ends 352, 354. Each of the pair of receivers 350 is shaped to the pair of wing-like extensions 312. When the collar 302 is assembled with the lock plate 304, each of the pair of receivers 350 abut the outer wing ends 330 of the pair of wing-like extension 312. Thereby, the pair of receivers 350 secure the collar 302 in the closed position.

Figure 8:
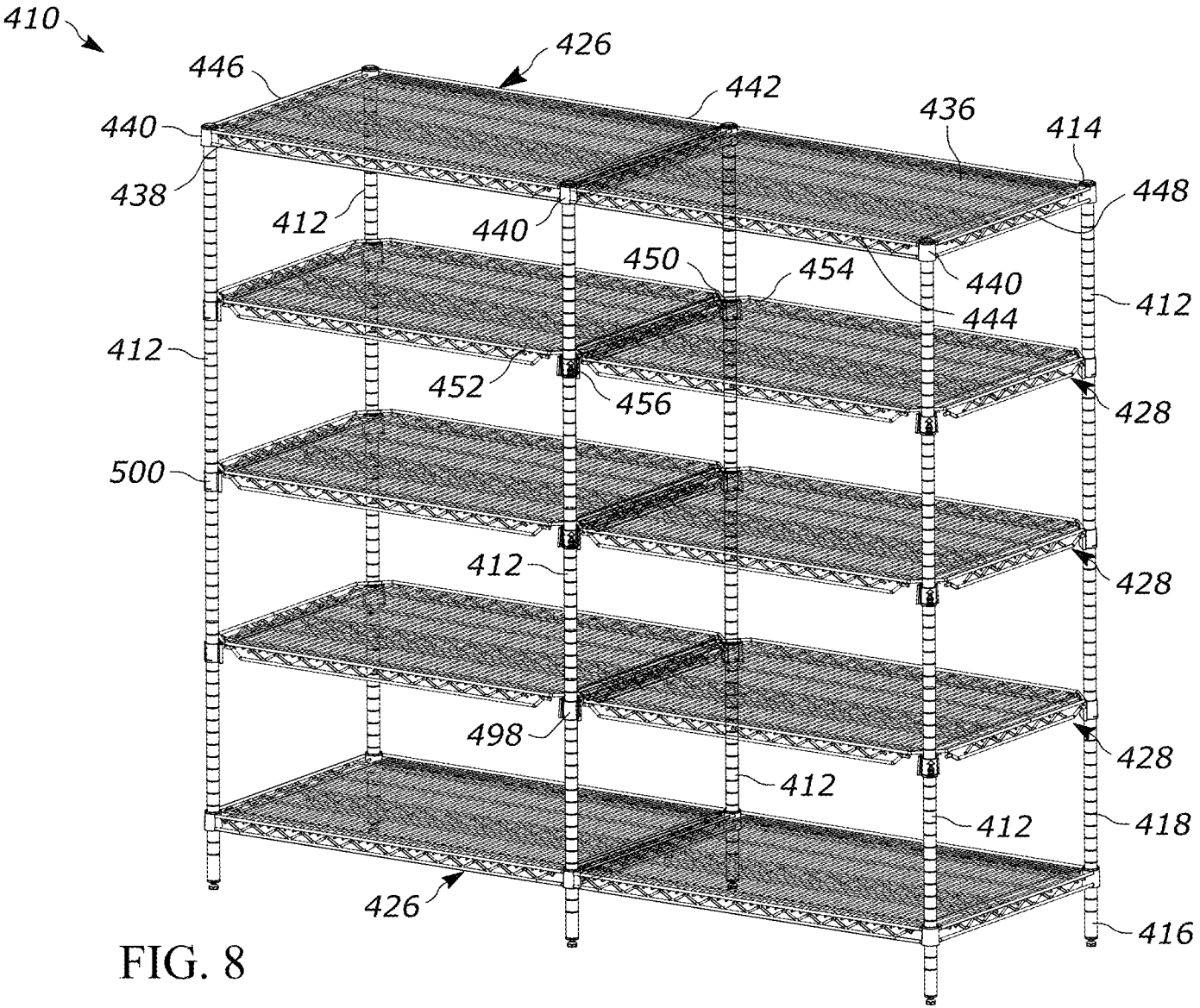
FIG. 8 is a perspective view of another shelving unit constructed in accordance with the present disclosure.

With reference to FIG. 8, another example shelving unit 410 is provided in accordance with the present disclosure. The shelving unit 410 includes a plurality of posts 412. Each post 412 extends between a first post end 414 and a second post end 416 that opposes the first post end 414. Each post 412 includes a plurality of grooves 418 that are spaced apart between the first and second post ends 414, 416. In the illustrated example, the plurality of posts 412 includes six posts 412. The six posts 412 are arranged in three columns and two rows when viewed from above the shelving unit 410. However, another suitable number of posts 412 may be used and the plurality of posts 412 may be arranged in another suitable configuration.

The shelving unit 410 may include one or more first shelves 426, one or more second shelves 428, or a combination thereof. In one example, as illustrated, the second shelves 428 are the same or substantially similar to the second shelves 28. In another example, the second shelves 428 are the same or substantially similar to the third shelves 30. Thus, the second shelves 428 will not be re-described again in detail. In the illustrated example, the shelving unit 410 includes two first shelves 426 and six second shelves 428. However, another suitable number of first shelves 426 and second shelves 428 may be used.

The first shelves 426 are coupled to each of the plurality of posts 412. The first shelves 426 may include a first shelf platform 436, a first siderail 438, and a plurality of receivers 440. The first shelf platform 436 is made of a metal material, a plastic material or another suitable material. The first shelf platform 436 may be formed as a wire grate, a basket, or another suitable configuration. The first shelf platform 436 extends between a first side 442 and a second side 444 that opposes the first side 442 and extends between a third side 446 and a fourth side 448 that opposes the third side 446. The first, second, third, and fourth sides 442, 444, 446, 448 cooperate to form a parallelogram shape with four corners. However, the first shelf platform 436 may include another suitable number of sides and may be formed in another suitable shape.

The first siderails 438 extend from the first shelf platform 436. The first siderail 438 extends from the first side 442, the second side 444, the third side 446, the fourth side 448, or a combination thereof. In the illustrated example, the first siderail 438 extend substantially in a downward direction (e.g., a direction from the first post end 414 to the second post end 416). In another example, the first siderails 438 extend substantially in an upward direction (e.g., a direction from the second post end 416 to the first post end 414).

The plurality of receivers 440 are positioned at the first shelf platform 436. A first one of the receivers 440 is positioned at the intersection of the first and third sides 442, 446. A second one of the receivers 440 is positioned at the intersection of the first and fourth sides 442, 448. A third one of the receivers 440 is positioned on the first side 442 equidistantly between the third and fourth sides 446, 448. A fourth one of the receivers 440 is positioned at the intersection of the second and third sides 444, 446. A fifth one of the receivers 440 is positioned at the intersection of the second and fourth sides 444, 448. A sixth one of the receivers 440 is positioned on the second side 444 equidistantly between the third and fourth sides 446, 448. Accordingly, the first shelf 426 of the illustrated example includes six receivers 440. However, another suitable number of receivers 440 may be used.

Each of the plurality of receivers 440 is shaped in a cylindrical shape and receives one of the plurality of posts 412. The plurality of receivers 440 are axially aligned with the respective posts 412 and movable along the respective post 412 between the first post end 414 and the second post end 416.

Two second shelves 428 are positioned beside each other. A first one of the second shelves 428 is coupled to four posts 412 and a second one of the second shelves 428 is coupled to four posts 412. Thus, the first and second ones of the second shelves 428 are coupled to two of the same posts 412. A first corner edge 450 and a second corner edge 452 of the first one of the second shelves 428 are positioned on an inboard side of the first one of the second shelves 428. A third corner edge 454 and a fourth corner edge 456 of the second one of the second shelves 428 are positioned on an inboard side of the second one of the second shelves 428. The first and third corner edges 450, 454 may be in mirror-image configuration, positioned adjacent to each other, and coupled to one post 412. The second and fourth corner edges 452, 456 may be in mirror-image configuration, positioned adjacent to each other, and coupled to another post 412.

Each of the second shelves 428 are attached to the posts 412 using first shelf attachment devices 498 and second shelf attachment devices 500. The first shelf attachment device 498 is configured to hold two second shelves 428 and the second shelf attachment device 500 is configured to hold one second shelf 428. The second shelf attachment device 500 is the same or substantially similar to the shelf attachment device 100 of the shelving unit 10. Accordingly, the second shelf attachment device 500 will not be re-described in detail.

Figure 9:
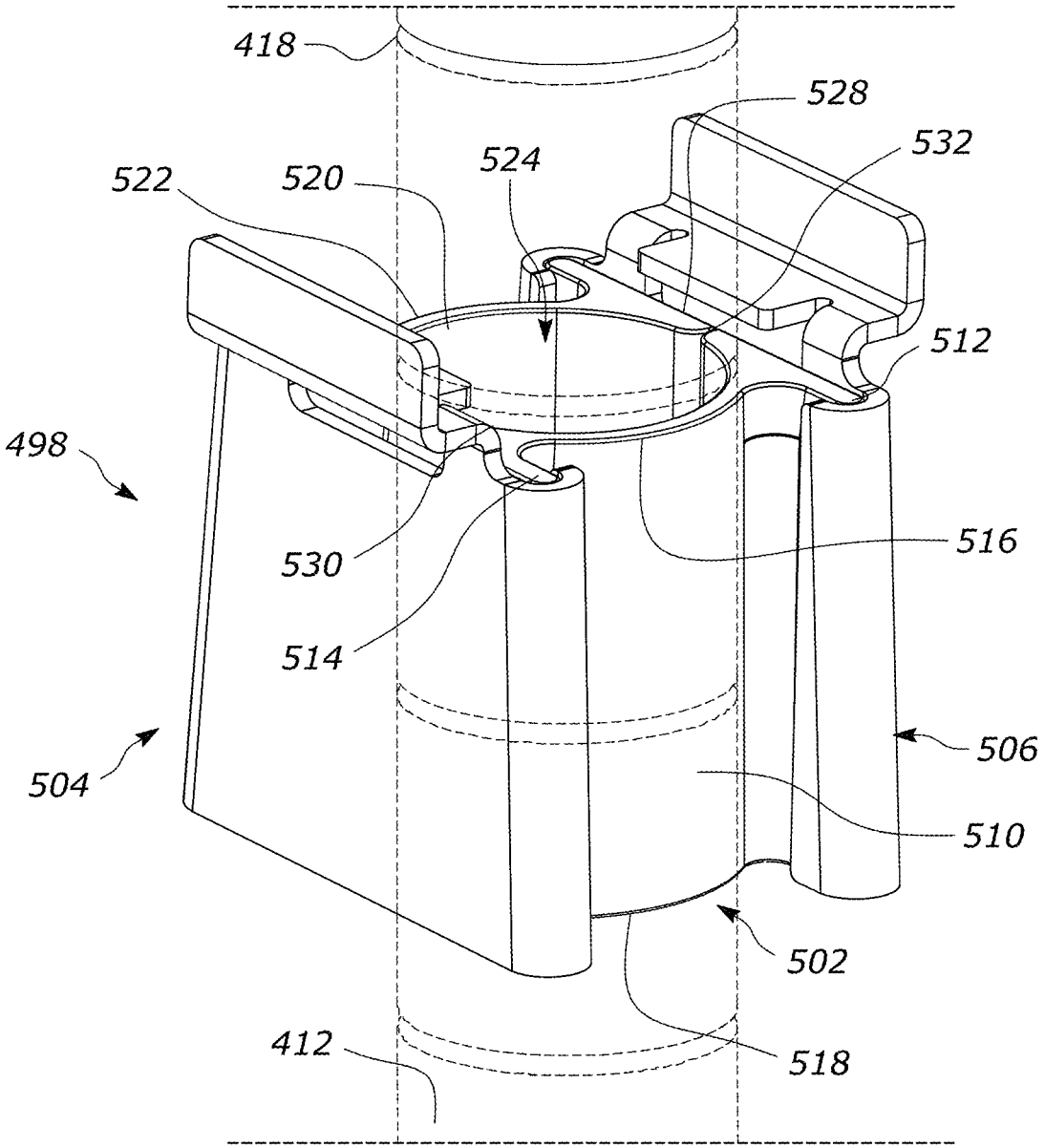
FIG. 9 is a perspective view of a shelf attachment device of the shelving unit shown in FIG. 6.

As shown in FIG. 9, the first shelf attachment device 498 includes a collar 502, a first lock plate 504, and a second lock plate 506. The first and second lock plates 504, 506 are the same or substantially similar. Furthermore, the first and second lock plates 504, 506 are the same or substantially similar to the lock plate 104 of the shelf attachment device 100. Therefore, the first and second lock plates 504, 506 will not be re-described in detail.

The collar 502 includes a body 510, a first pair of wing-like extensions 512, and a second pair of wing-like extensions 514. The body 510 is shaped and sized to contour the cross-sectional shape and size of the post 412. The body 510 extends between a first body end 516 and a second body end 518 that opposes the first body end 516. The body 510 has an interior surface 520 and an exterior surface 522 that opposes the interior surface 520. The interior surface 520 defines an opening 524 that extends between the first and second body ends 516, 518. An annular protrusion or rib (e.g., annular protrusion 126) extends from the interior surface 520 and is positioned adjacent to the second body end 518. The annular protrusion extends radially inward into the opening and extends annularly about the body 510. The annular protrusion is shaped and sized to be positioned within one indent 418 of the post 412 in the slip-fit arrangement.

The body 510 has a first side 528 and a second side 530. In the illustrated example, the second side 530 is opposite the first side 528. In other words, the second side 530 is 180 degrees away from the first side 528 in an annular direction. However, the second side 530 may be another suitable angle away from the first side 528 in the annular direction. A slit 532 extends through the first side 528 of the body 510 and extends between the first body end 516 and the second body end 518. The slit 532 provides lateral access to the opening 524 of the body 510. The body 510 is made of a material that is flexible and resilient, or another suitable material.

The first pair of wing-like extensions 512 are disposed on the first side 528 of the body 510. More specifically, the first pair of wing-like extensions 512 extend tangentially away from the first side 528 of the body 510 in opposite directions. The second pair of wing-like extensions 514 are disposed on the second side 530 of the body 510. More specifically, the second pair of wing-like extensions 514 extend tangentially away from the second side 530 of the body 510 in opposite directions. The first pair of wing-like extensions 512 are the same or substantially similar to the pair of wing-like extensions 112 of the shelf attachment device 100 and the second pair of wing-like extensions 514 are the same or substantially similar to the pair of wing-like extensions 112 of the shelf attachment device 100. Accordingly, the first and second pairs of wing-like extensions 512, 514 will not be re-described in detail.

The first lock plate 504 is slidably engaged with the first pair of wing-like extensions 512. The second lock plate 506 is slidably engaged with the second pair of wing-like extensions 514. Accordingly, the first shelf attachment device 498 is configured to hold the first one of the second shelves 428 using the first lock plate 504 and hold the second one of the second shelves 428 using the second lock plate 506.

The respective corner edges 450, 452, 454, 456 of the second shelves 428 may be shaped, sized, and positioned to rest on the first and second lock plates 504, 506. In the illustrated example, the first and second pair of wing-like extensions 512, 514 and thus, the first and second lock plates 504, 506 are positioned on opposite sides of the body 510. Accordingly, a wall of the first corner edge 450 is opposite to and in parallel with a wall of the third corner edge 454 such that the walls of first and third corner edges 450, 454 rest on the first and second lock plates 504, 506, respectively. A wall of the second corner edge 452 is opposite to and in parallel with a wall of the fourth corner edge 456 such that the walls of second and fourth corner edges 452, 456 rest on the first and second lock plates 504, 506, respectively.

In another example, the first and second pair of wing-like extensions 512, 514 and thus, the first and second lock plates 504, 506 may be positioned about 90 degrees away from each other in the annular direction. Accordingly, the respective corner edges 450, 452, 454, 456 of the second shelves 428 is positioned at an obtuse angle relative to adjacent sides of the second shelves 428, as in the corner edge 74 of the second shelf 28.

Figure 10:
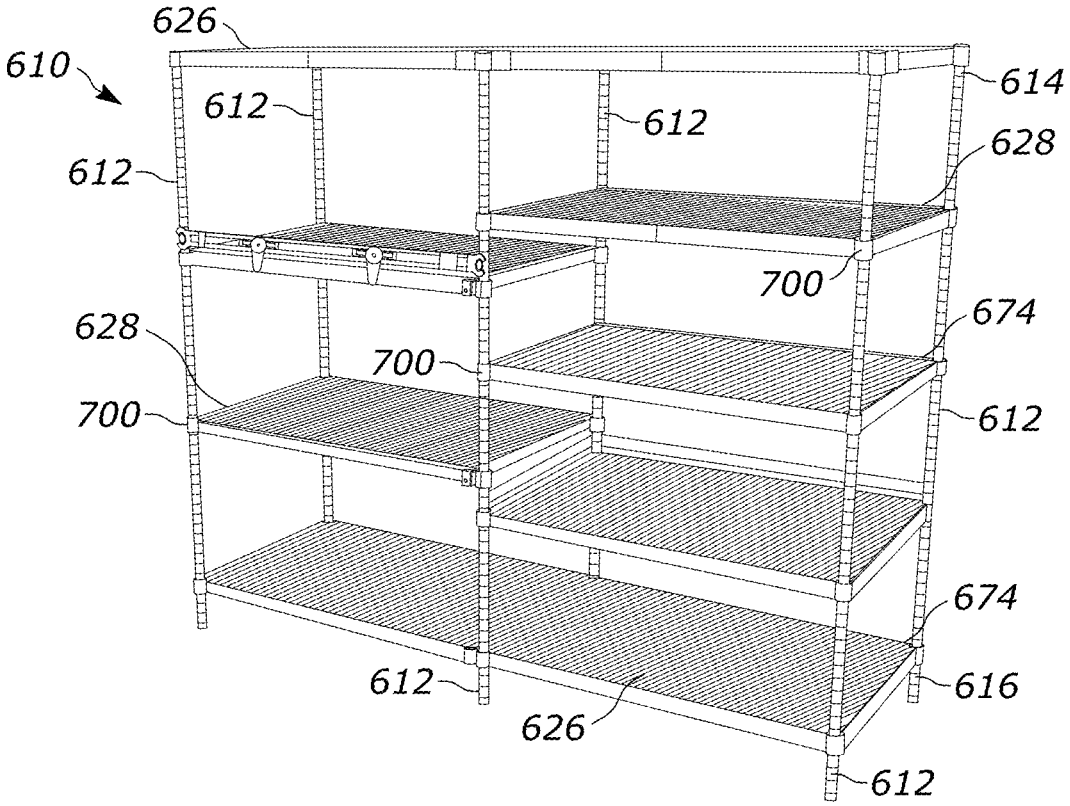
FIG. 10 is a perspective view of another shelving unit constructed in accordance with the present disclosure.
Figure 11:
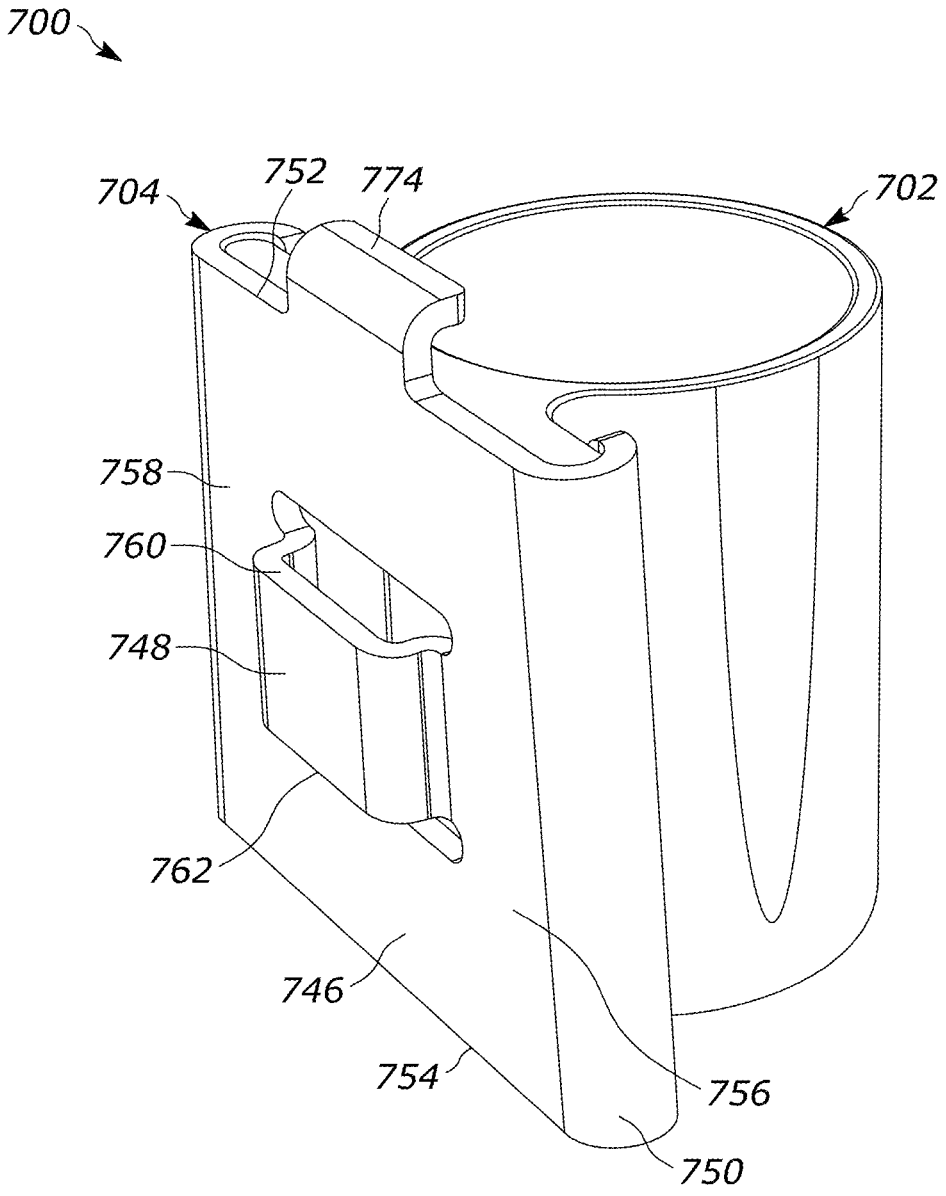
FIG. 11 is a perspective view of a shelf attachment device of the shelving unit shown in FIG. 8.

With reference to FIGS. 10-11, another example shelving unit 610 is provided in accordance with the present disclosure. The shelving unit 610 includes a plurality of posts 612. The plurality of posts 612 is the same or substantially similar to the plurality of posts 412 of the shelving unit 410. Accordingly, the plurality of posts 612 will not be re-described in detail. Each post 612 extends between a first post end 614 and a second post end 616 that opposes the first post end 614.

The shelving unit 610 may include one or more first shelves 626, one or more second shelves 628, or a combination thereof. The first shelves 626 are the same or substantially similar to the first shelves 426 of the shelving unit 410. In one example, the second shelves 628 are the same or substantially similar to the second shelves 28 of the shelving unit 10 and the second shelves 428 of the shelving unit 410. In another example, the second shelves 628 are the same or substantially similar to the third shelves 30 of the shelving unit 10. Thus, the first and second shelves 626, 628 will not be re-described again in detail. Each of the second shelves 628 include corner edges 674.

In the illustrated example, the shelving unit 610 includes two first shelves 626 and five second shelves 628. A first one of the first shelves 626 is positioned at the first post end 614 and a second one of the first shelves 626 is positioned adjacent to the second post end 616. The second shelves 628 are staggered and positioned between the first and second post ends 614, 616. However, another suitable number and positioning of first shelves 626 and second shelves 628 may be used.

Each of the second shelves 628 are attached to the posts 612 using shelf attachment devices 700. Each shelf attachment device 700 may include a collar 702 and a lock plate 704. As in the shelf attachment device 100, the collar 702 is flexed to the open position to receive one of the posts 612 and subsequently, the lock plate 704 is slidably engaged with the collar 702 to secure the shelf attachment device 700 to the post 612. The collar 702 is the same or substantially similar to the collar 102 of the shelf attachment device 100. Accordingly, the collar 702 will not be re-described in detail.

The lock plate 704 may include a base plate 746, a ledge 748, a pair of receivers 750, and a lip 774. The base plate 746 is the same or substantially similar to the base plate 146 of the attachment device 100 and the pair of receivers 750 are the same or substantially similar to the pair of receivers 150 of the attachment device 100. Accordingly, the base plate 746 and the pair of receivers 750 will not be re-described in detail. The base plate 746 extends longitudinally between a first plate end 752 and a second plate end 754 that opposes the first plate end 752. The base plate 746 extends laterally between a third plate end 756 and a fourth plate end 758 that opposes the third plate end 756.

The ledge 748 is disposed between the first and second plate ends 752, 754, and between the third and fourth plate ends 756, 758. In the illustrated example, the ledge 748 is formed as a stamped protrusion that extends in a direction opposite of the pair of receivers 750. The ledge 748 includes a first ledge end 760 and a second ledge end 762 that opposes the first ledge end 760. The first ledge end 760 is positioned adjacent to the first plate end 752 of the base plate 746. The second ledge end 762 is positioned adjacent to the second plate end 754. One corner edge 674 of the second shelves 628 may rest on the first ledge end 760 of the ledge 748 or fit with a secondary support device.

The lip 774 is disposed at the first plate end 752 and extends in a direction opposite to the ledge 748. The lip 774 has a curved-shaped profile and extends over the collar 702 when the collar 702 is slidably engaged with the lock plate 704.

Figure 12:
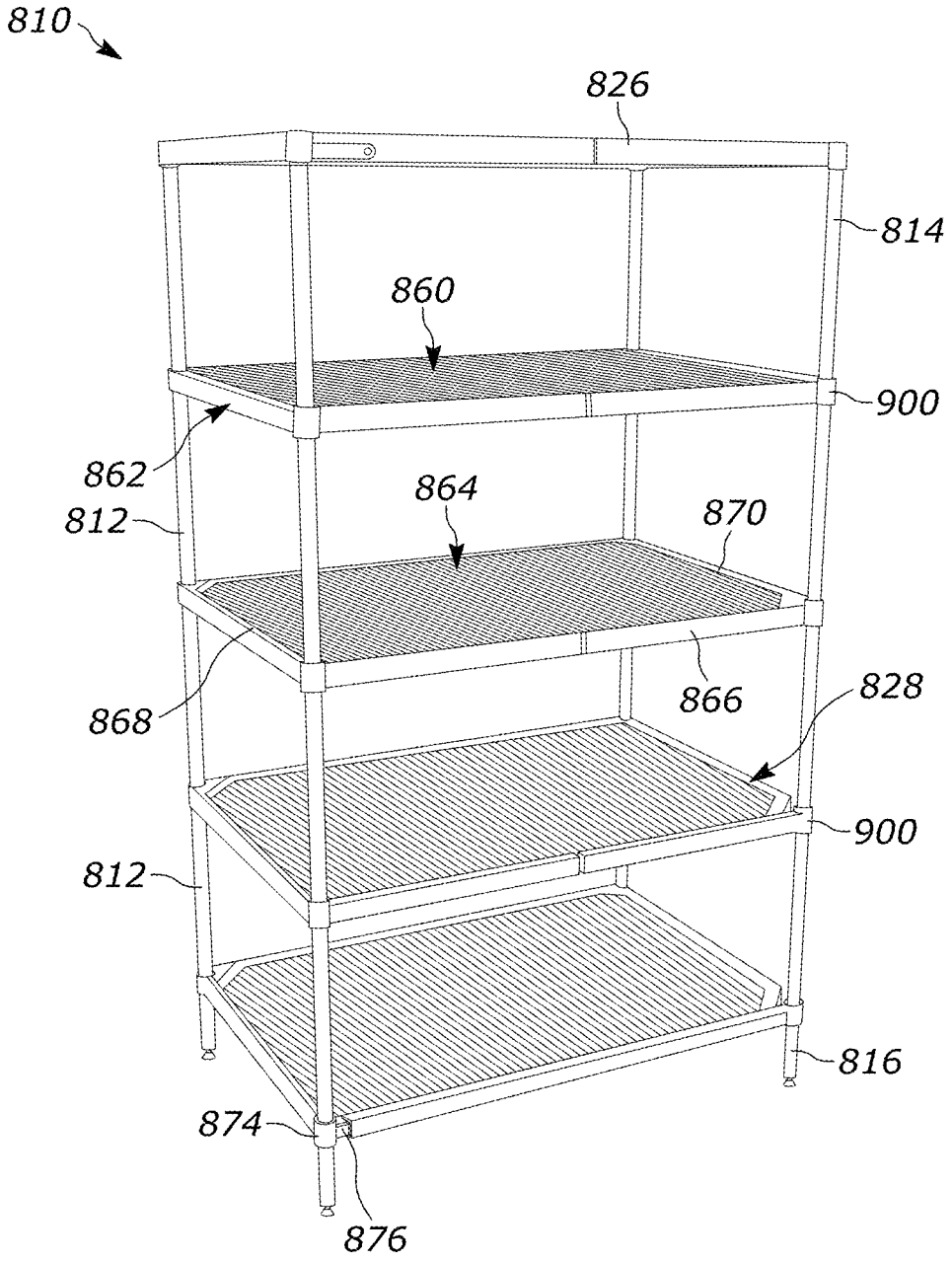
FIG. 12 is a perspective view of another shelving unit constructed in accordance with the present disclosure.
Figure 13:
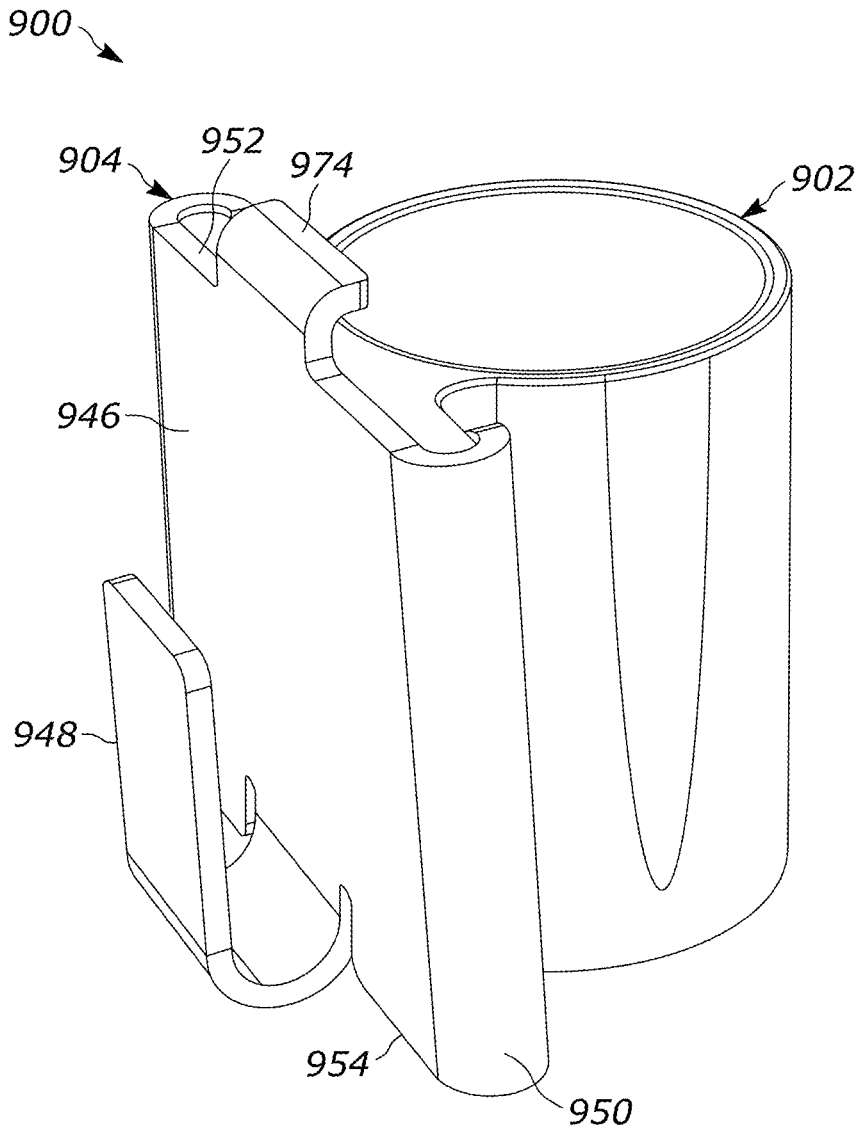
FIG. 13 is a perspective view of a shelf attachment device of the shelving unit shown in FIG. 10.
Figure 14:
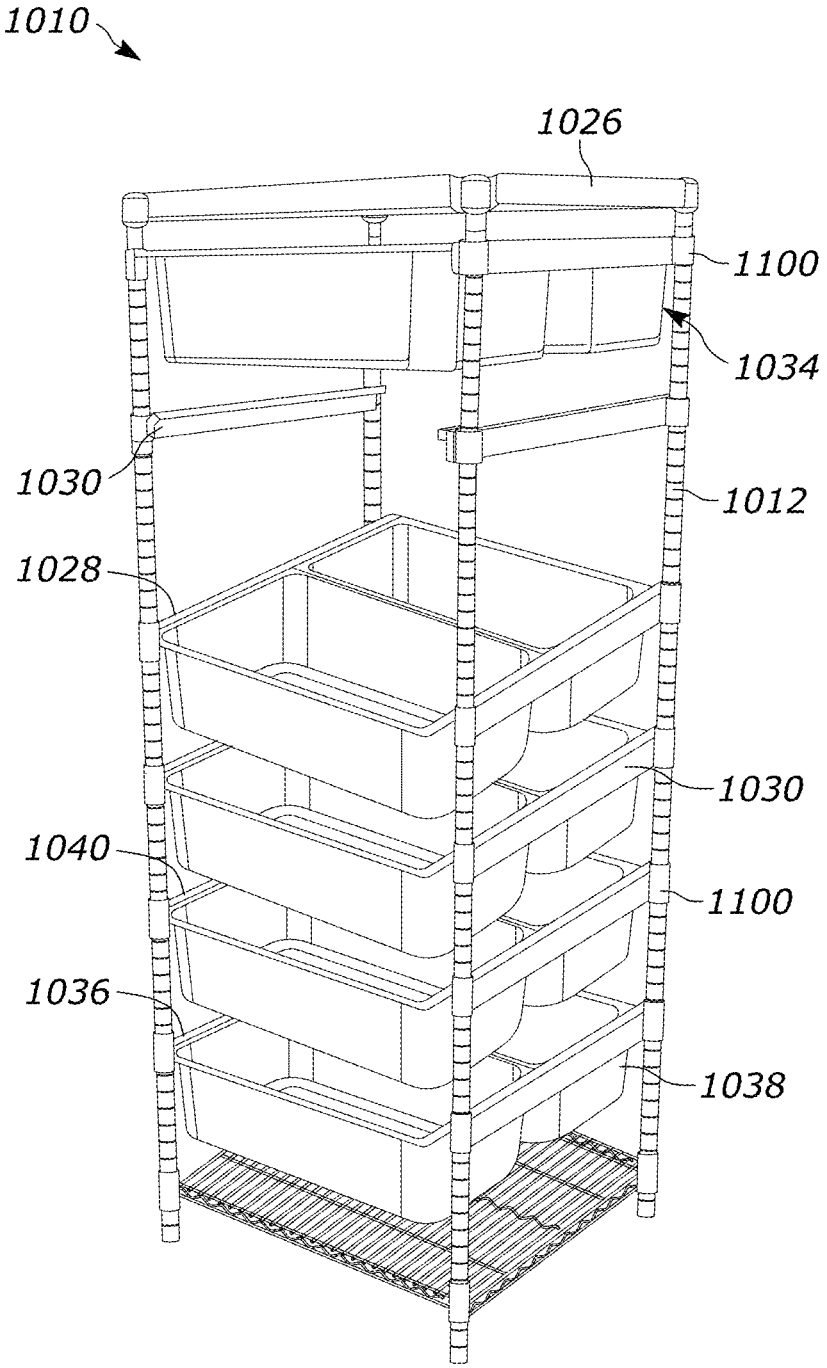
FIG. 14 is a perspective view of another shelving unit constructed in accordance with the present disclosure, where a plurality of shelves each include two baskets.

With reference to FIGS. 12-13, another example shelving unit 810 is provided in accordance with the present disclosure. The shelving unit 810 includes a plurality of posts 812. The plurality of posts 812 is the same or substantially the same as the plurality of posts 12 of the shelving unit 10. Accordingly, the plurality of posts 812 will not be re-described in detail. Each post 812 extends between a first post end 814 and a second post end 816 that opposes the first post end 814.

The shelving unit 810 may include one or more first shelves 826, one or more second shelves 828, or a combination thereof. In the illustrated example, the shelving unit 810 includes one first shelf 826 and four second shelves 828. The first shelf 826 is positioned at the first post end 814. The second shelves 828 are spaced apart between the first shelf 826 and the second post end 816. However, another suitable number and positioning of first shelf 826 and second shelves 828 may be used.

The first shelf 826 is the same or substantially similar to the first shelves 26 of the shelving unit 10. Thus, the first shelves 826 will not be re-described again in detail.

The second shelf 828 may include a second shelf platform 860 and a second border siderail 862. The second shelf platform 860 extends between a first side 864 and a second side 866 that opposes the first side 864 and extends between a third side 868 and a fourth side 870 that opposes the third side 868. The first, second, third, and fourth sides 864, 866, 868, 870 cooperate to form a parallelogram shape with four corners. However, the second shelf platform 860 may have another suitable number of sides configured in another suitable arrangement. The second shelf platform 860 may include a first corner edge 874 disposed at each of the corners of the second shelf platform 860.

The second siderail 862 borders the first side 864, the second side 866, the third side 868, the fourth side 870, or a combination thereof. In the illustrated example, the second siderail 862 borders each of the first, second, third, and fourth sides 864, 866, 868, 870 of the second shelf platform 860. The second siderail 862 extends substantially in the downward direction. A second corner edge 876 extends between adjacent sides 864, 866, 868, 870 of the second shelf platform 860. In other words, the second corner edge 876 is positioned below the first corner edge 874 of the second shelf platform 860.

Each of the second shelves 828 are attached to the posts 812 using shelf attachment devices 900. Each shelf attachment device 900 may include a collar 902 and a lock plate 904. As in the attachment device 100, the collar 902 is flexed to the open position to receive one of the posts 812 and subsequently, the lock plate 904 is slidably engaged with the collar 902 to secure the shelf attachment device 900 to the post 812. The collar 902 is the same or substantially similar to the collar 102 of the shelf attachment device 100. Accordingly, the collar 902 will not be re-described in detail.

The lock plate 904 may include a base plate 946, a ledge 948, a pair of receivers 950, and a lip 974. The base plate 946 is the same or substantially similar to the base plate 146 of the shelf attachment device 100. The pair of receivers 950 is the same or substantially similar to the pair of receivers 150 of the attachment device 100. The lip 974 is the same or substantially similar to the lip 774 of the shelf attachment device 700. Accordingly, the base plate 946, the pair of receivers 950, and the lip 974 will not be re-described in detail. The base plate 946 extends longitudinally between a first plate end 952 and a second plate end 954 that opposes the first plate end 952.

The ledge 948 is disposed at the second plate end 954. In the illustrated example, the ledge 948 has a hook-shaped profile that extends in a direction toward the first plate end 952. One second corner edge 876 of the second shelves 828 may rest within each ledge 948. In one example, the ledge 948 may be shaped and sized such that the first and second corner edges 874, 876 of the second shelves 828 may rest within the ledge 948.

With reference to FIGS. 14-19, another example shelving unit 1010 is provided in accordance with the present disclosure. The shelving unit 1010 includes a plurality of posts 1012. The plurality of posts 1012 is the same or substantially similar to the posts 12 of the shelving unit 10. Accordingly, the plurality of posts 1012 will not be re-described in detail.

The shelving unit 1010 may include one or more first shelves 1026, and one or more second shelves 1028. The first shelves 1026 are the same or substantially similar to the first shelves 26 of the shelving unit 10 and thus, will not be re-described in detail. The second shelves 1028 include a set of siderails 1030. A first one of the siderails 1030 is coupled to two posts 1012 and a second one of the siderails 1030 is coupled to two posts 1012. The first and second ones of the siderails 1030 are positioned opposite to each other and in parallel.

In one example, the second shelf 1028 includes one or more baskets 1034 engaged with the set of siderails 1030. The baskets 1034 are shaped and sized to accommodate the set of siderails 1030. FIG. 12 illustrates two baskets 1034 slidably engaged with each set of siderails 1030. FIG. 13 illustrates one basket 1034 slidably engaged with each set of siderails 1030. Each of the set of baskets 1034 includes a first side 1036 and a second side 1038 opposes the first side 1034. A rim 1040 is disposed at the first and second sides 1036, 1038 of the basket 1034. The rim 1040 that is positioned at the first side 1036 of the basket 1034 may be slidably received in a first one of the siderails 1030 and the rim 1040 that is positioned at a second side of the basket 1034 may be slidably received in the second one of the siderails 1030.

Figure 15:
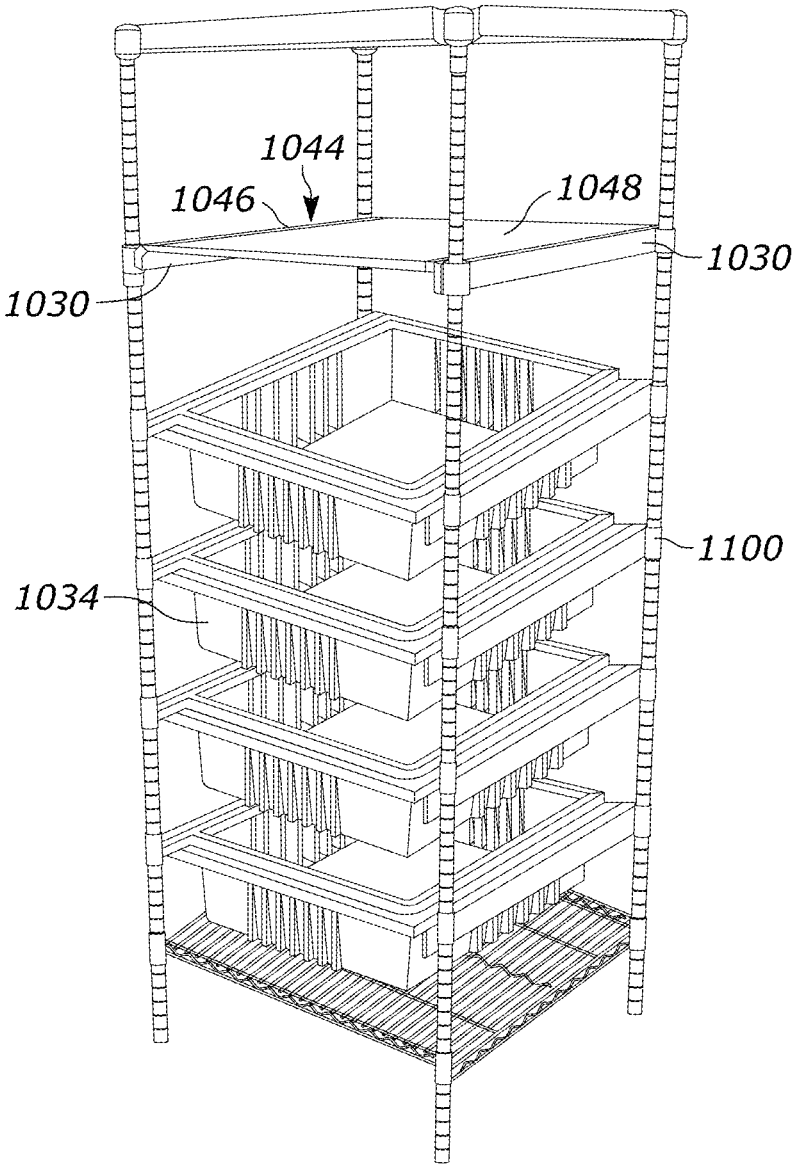
FIG. 15 is a perspective view of the shelving unit shown in FIG. 12, where the plurality of shelves each include one basket or a shelf platform.

In another example, as illustrated in FIG. 15, the second shelf 1028 includes a shelf platform 1044 engaged with the set of siderails 1030. The shelf platform 1044 has a substantially flat profile. The shelf platform 1044 extends between a first side 1046 and a second side 1048 that opposes the first side 1046. The first side 1046 may be received within a first one of the siderails 1030. The second side 1048 may be received within a second one of the siderails 1030.

Figure 16:
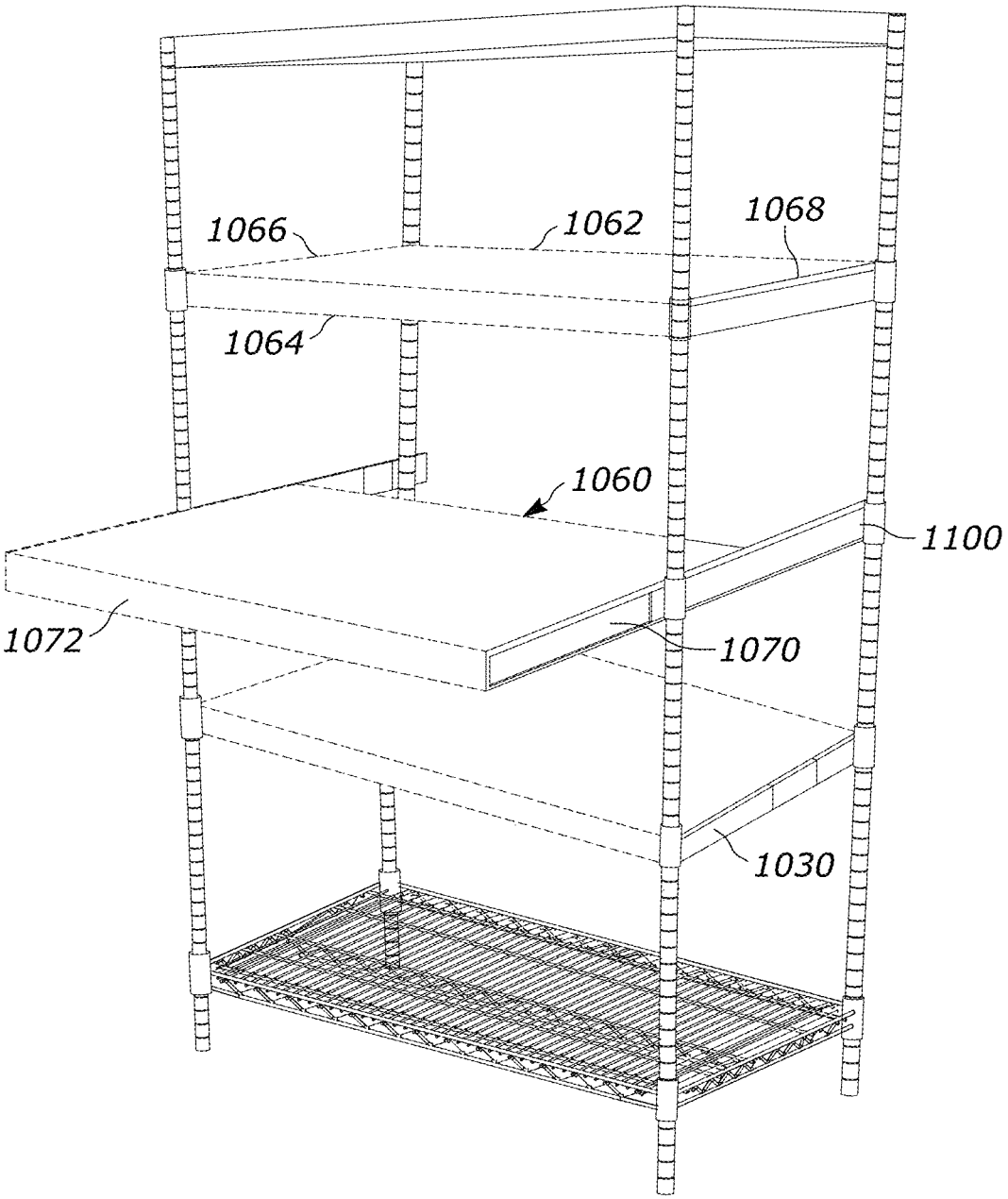
FIG. 16 is a perspective view of the shelving unit shown in FIG. 12, where the plurality of shelves each include a sliding platform.

In yet another example, as illustrated in FIG. 16, the second shelf 1028 includes a sliding platform 1060 engaged with the set of siderails 1030. The sliding platform 1060 extends between a first side 1062 and second side 1064 that opposes the first side 1062, and extends laterally between a third side 1066 and a fourth side 1068 that opposes the third side 1066. A set of sliding rails 1070 may be secured to the third and fourth sides 1066, 1068 and the set of siderails 1030. The sliding rails 1070 are fixedly attached to the sliding platform 1060 and slidably attached to the siderails 1030. A front panel 1072 may be disposed at the second side 1064 of the sliding platform 1060.

The sliding platform 1060 is movable between an extended position and a retracted position and the sliding rails 1070 moves relative to the siderails 1030. The sliding platform 1060 moves from the retracted position to the extended position by pulling on the front panel 1072 in a direction away from the plurality of posts 1012. The sliding platform 1060 moves from the extended position to the retracted position by pushing on the front panel 1072 in a direction toward the plurality of posts 1012.

Figure 17:
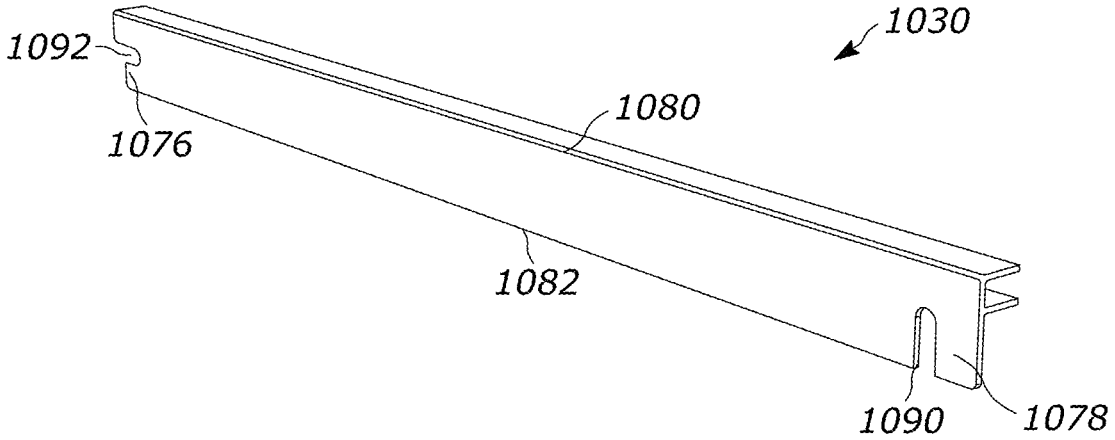
FIG. 17 is a perspective view of a siderail of the shelving units shown in FIGS. 12-14.
Figure 18:
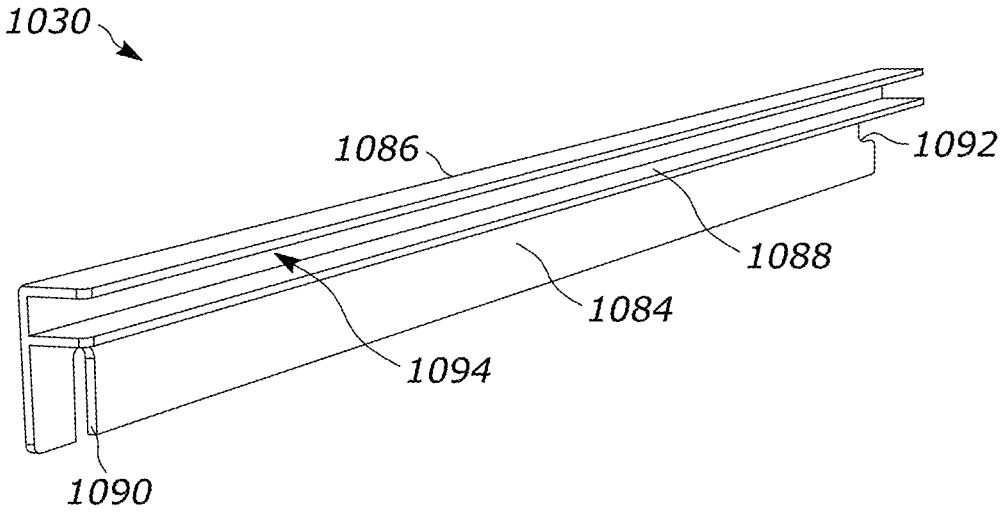
FIG. 18 is a perspective view of the siderail shown in FIG. 15.

As shown in FIGS. 17-18, each of the siderails 1030 extend longitudinally between a first rail end 1076 and a second rail end 1078 that opposes the first rail end 1076. Each of the siderails 1030 extend between a third rail end 1080 and a fourth rail end 1082 that opposes the third rail end 1080. The siderail 1030 includes a first wall 1084, a second wall 1086, and a third wall 1088. The first wall 1084 extends between the first and second rail ends 1076, 1078 and extends between the third and fourth rail ends 1080, 1082. The first wall 1084 includes a first recess 1090 and a second recess 1092. The first recess 1090 extends in a direction from the fourth rail end 1082 toward the third rail end 1080 and is positioned adjacent to the second rail end 1078. The second recess 1092 extends in a direction from the first rail end 1076 toward the second rail end 1078 and is positioned between the third and fourth rail ends 1080, 1082.

The second wall 1086 extends from the first wall 1084 at the third rail end 1080 to define an L-shaped profile. The second wall 1086 extends between the first and second rail ends 1076, 1078. Additionally, the third wall 1088 extends from the first wall 1084 and is positioned between the second wall 1086 and the fourth rail end 1082. In other words, the third wall 1088 is spaced from the second wall 1086. The third wall 1088 extends longitudinally between the first and second rail ends 1076, 1078 and is substantially parallel to the second wall 1086. Accordingly, a cavity 1094 is formed between the second and third walls 1086, 1088. In one example, the rim 1040 of the baskets 1034 is positioned within the cavity 1094 when the baskets 1034 are slidably engaged with the set of siderails 1030. In another example, the first and second sides 1046, 1048 of the shelf platform 1044 are positioned within the cavity 1094 when the shelf platform 1044 is slidably engaged with the set of siderails 1030.

The set of siderails 1030 are coupled to the posts 1012 using shelf attachment devices 1100. More specifically, a first one of the shelf attachment devices 1100 is slidably engaged with the first recess 1090 of the siderail 1030 and a second one of the shelf attachment devices 1100 is slidably engaged with the second recess 1092 of the siderail 1030.

Figure 19:
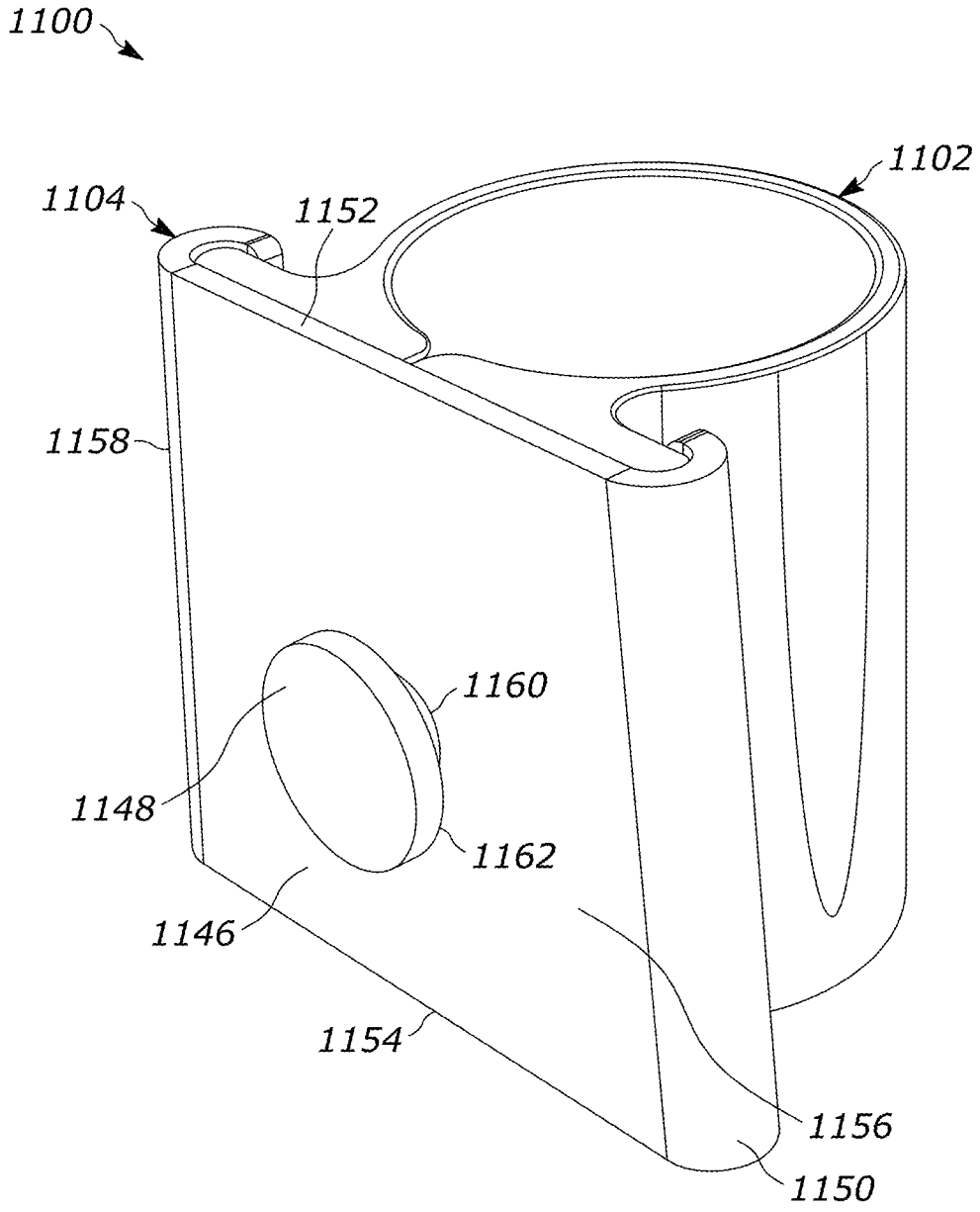
FIG. 19 is a perspective view of a shelf attachment device of the shelving units shown in FIGS. 12-14.

With reference to FIG. 19, each shelf attachment device 1100 may include a collar 1102 and a lock plate 1104. As in the attachment device 100, the collar 1102 is flexed to the open position to receive one of the posts 1012 and subsequently, the lock plate 1104 is slidably engaged with the collar 1102 to secure the shelf attachment device 1100 to the post 1012. The collar 1102 is the same or substantially similar to the collar 102 of the shelf attachment device 100 and thus, the collar 1102 will not be re-described in detail.

The lock plate 1104 may include a base plate 1146, a ledge 1148, and a pair of receivers 1150. The base plate 1146 is the same or substantially similar to the base plate 146 and the pair of receivers 1150 are the same or substantially similar to the pair of receivers 150 of the attachment device 100. Accordingly, the base plate 1146 and the pair of receivers 1150 will not be re-described in detail. The base plate 1146 extends longitudinally between a first plate end 1152 and a second plate end 1154 that opposes the first plate end 1152. The base plate 1146 extends laterally between a third plate end 1156 and a fourth plate end 1158 that opposes the third plate end 1156.

The ledge 1148 extends from the base plate 1146. The ledge 1148 is disposed opposite to the collar 1102 when the collar 1102 is engaged with the lock plate 1104. In the illustrated example, the ledge 1148 is positioned about equidistantly between the first and second plate ends 1152, 1154 and positioned about equidistantly between the third and fourth plate ends 1156, 1158. The ledge 1148 includes a first portion 1160 and a second portion 1162. However, the ledge 1148 may be positioned in another suitable position relative to the base plate 1146. The first portion 1160 is directly attached to the base plate 1146 and the second portion 1162 extends from the first portion 1160. The first portion 1160 is shaped and sized to be smaller than the first and second recesses 1090, 1092 of the siderail 1030. The second portion 1162 is shaped and sized to be larger than the first and second recesses 1090, 1092 of the siderail 1030.

After the shelf attachment device 1100 is secured to the posts 1012, the siderail 1030 is slidably engaged with the ledge 1148 of the shelf attachment device 1100. More specifically, the first and second recesses 1090, 1092 of the siderail 1030 are slidably engaged with the ledge 1148. The first portion 1160 of the ledge 1148 is positioned within the first and second recesses 1090, 1092. The second portion 1162 is positioned outboard of the first wall 1084 of the siderail 1030 and thus, retains the shelf attachment device 1100 to the siderail 1030.

Figure 20:
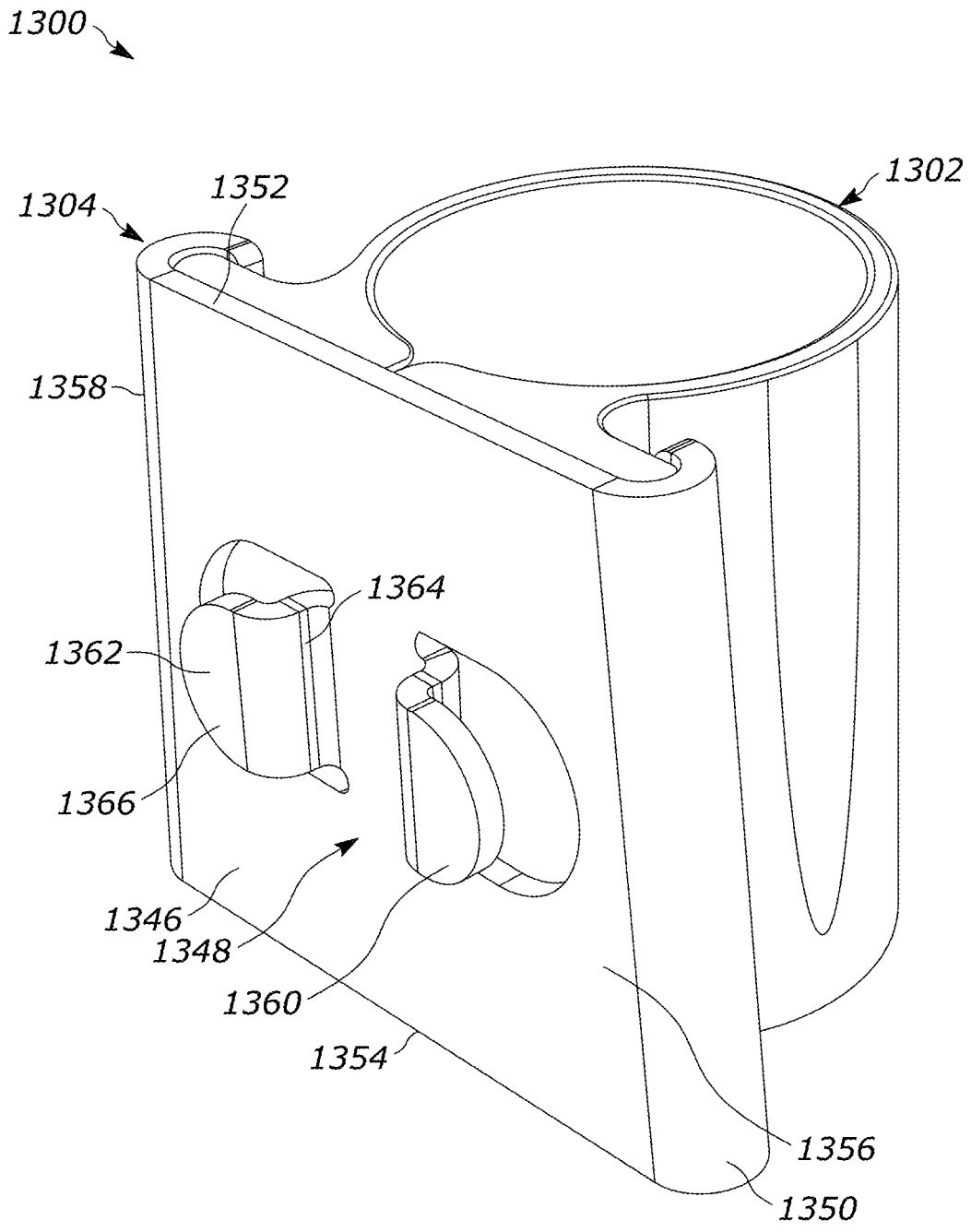
FIG. 20 is a perspective view of another shelf attachment device constructed in accordance with the present disclosure and compatible with the shelving units shown in FIGS. 12-14.

With reference to FIG. 20, another shelf attachment device 1300 is provided in accordance with the present disclosure. The shelf attachment device 1300 may be used in the shelving unit 1010 to secure the second shelves 1028 to the posts 1012, instead of the shelf attachment device 1100. The shelf attachment device 1300 includes a collar 1302 and a lock plate 1304. As in the attachment device 100, the collar 1302 is flexed to the open position to receive one of the posts 1012 and subsequently, the lock plate 1304 is slidably engaged with the collar 1302 to secure the shelf attachment device 1300 to the post 1012. The collar 1302 is the same or substantially similar to the collar 102 of the shelf attachment device 100. Accordingly, the collar 1302 will not be re-described in detail.

The lock plate 1304 may include a base plate 1346, a ledge 1348, and a pair of receivers 1350. The base plate 1346 is the same or substantially similar to the base plate 146 and the pair of receivers 1350 are the same or substantially similar to the pair of receivers 150 of the attachment device 100. Accordingly, the base plate 1346 and the pair of receivers 1350 will not be re-described in detail. The base plate 1346 extends longitudinally between a first plate end 1352 and a second plate end 1354 that opposes the first plate end 1352. The base plate 1346 extends laterally between a third plate end 1356 and a fourth plate end 1358 that opposes the third plate end 1356.

The ledge 1348 extends from the base plate 1346. In the illustrated example, the ledge 1348 is positioned about equidistantly between the first plate end 1352 and the second plate end 1354, and between the third plate end 1356 and the fourth plate end 1358. However, the ledge 1348 may be positioned in another suitable position relative to the base plate 1346. The ledge 1348 includes a first lip 1360 and a second lip 1362. Each of the first and second lip 1360, 1362 includes a first wall 1364 and a second wall 1366 that cooperate to form an L-shaped profile. The first wall 1364 extends away from the base plate 1346. The second wall 1366 of the first lip 1360 extends from the first wall 1364 in a direction toward the third plate end 1356. The second wall 1366 of the second lip 1362 extends from the first wall 1364 in a direction toward the fourth plate end 1358. The second walls 1366 are spaced apart from the base plate 1346.

After the shelf attachment device 1300 is secured to the posts 1012, the siderail 1030 is slidably engaged with the ledge 1348 of the shelf attachment device 1300. More specifically, the first recess 1090 of the siderail 1030 is slidably engaged with the ledge 1348 such that the first wall 1084 of the siderail 1030 is positioned between the first lip 1360 and the base plate 1346 and between the second lip 1362 and the base plate 1346. The second recess 1092 of the siderail 1030 is slidably engaged between with the ledge 1348 such that the first wall 1084 of the siderail 1030 is positioned between the first lip 1360 and the base plate 1346. Thereby, the siderail 1030 is secured to the shelf attachment device 1300.

Figure 21:
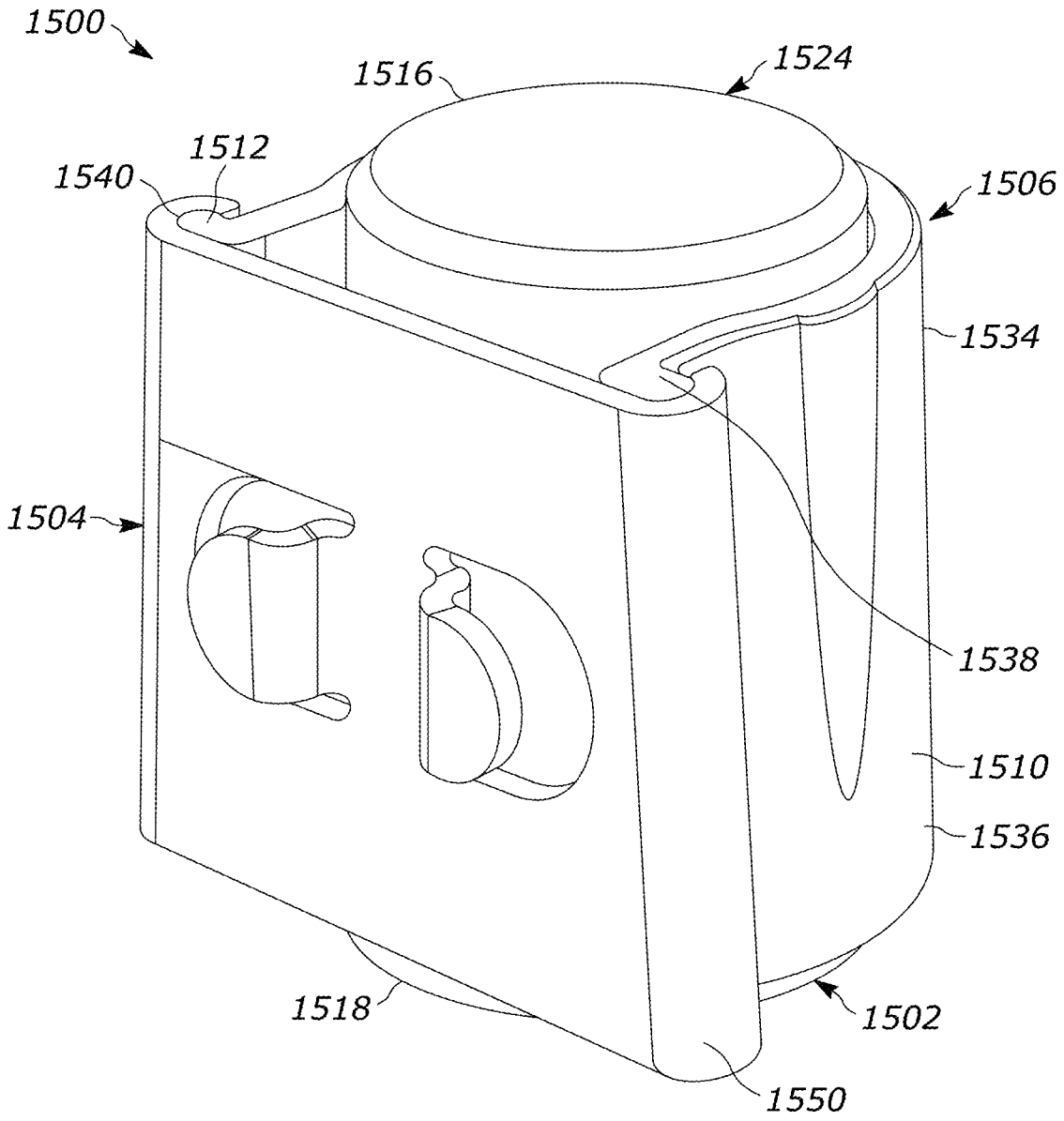
FIG. 21 is a perspective view of another shelf attachment device constructed in accordance with the present disclosure and compatible with the shelving units shown in FIGS. 12-14.

With reference to FIG. 21, another shelf attachment device 1500 is provided in accordance with the present disclosure. The shelf attachment device 1500 may be used in the shelving unit 1010 to secure the second shelves 1028 to the posts 1012, instead of the shelf attachment device 1100. The shelf attachment device 1500 includes a collar 1502, a first lock plate 1504, and a second lock plate 1506. The collar 1502 is de-assembled to receive one of the posts 1012 and assembled around the posts 1012 after receiving one of the posts 1012. The second lock plate 1506 is slidably engaged with the collar 1302 and subsequently, the first lock plate 1504 is slidably engaged with the second lock plate 1506 to secure the shelf attachment device 1500 to the post 1012.

The collar 1502 extends between a first collar end 1516 and a second collar end 1518 that opposes the first collar end 1516. The collar 1502 has a cylindrical-shaped profile with an opening 1524 that extends between the first and second collar ends 1516, 1518. The collar 1502 is split into two haves (see FIG. 22) that can be separated or de-assembled and interlocked or assembled together.

The first lock plate 1504 is the same or substantially similar to the lock plate 1304 and thus, will not be re-described in detail. The first lock plate 1504 includes a pair of receivers 1550. The second lock plate 1506 includes a body 1510 and a pair of wing-like projections 1512. The body 1510 extends longitudinally between a first body end 1534 and a second body end 1538 that opposes the first body end 1534, and extends laterally between a third body end 1538 and a fourth body end 1540 that opposes the third body end 1538. The body 1510 has a u-shaped profile such that the body 1510 wraps at least partially around the collar 1502. A first one of the pair of wing-like projections 1512 is disposed at the third body end 1538. A second one of the pair of wing-like projections 1512 is disposed at the fourth body end 1540. The first and second ones of the wing-like projections 1512 extend away from each other. Each of the pair of wing-like projections 1512 extends between the first and second body ends 1534, 1536. The pair of receivers 1550 slidably engage with the pair of wing-like projections 1512.

Figure 22:
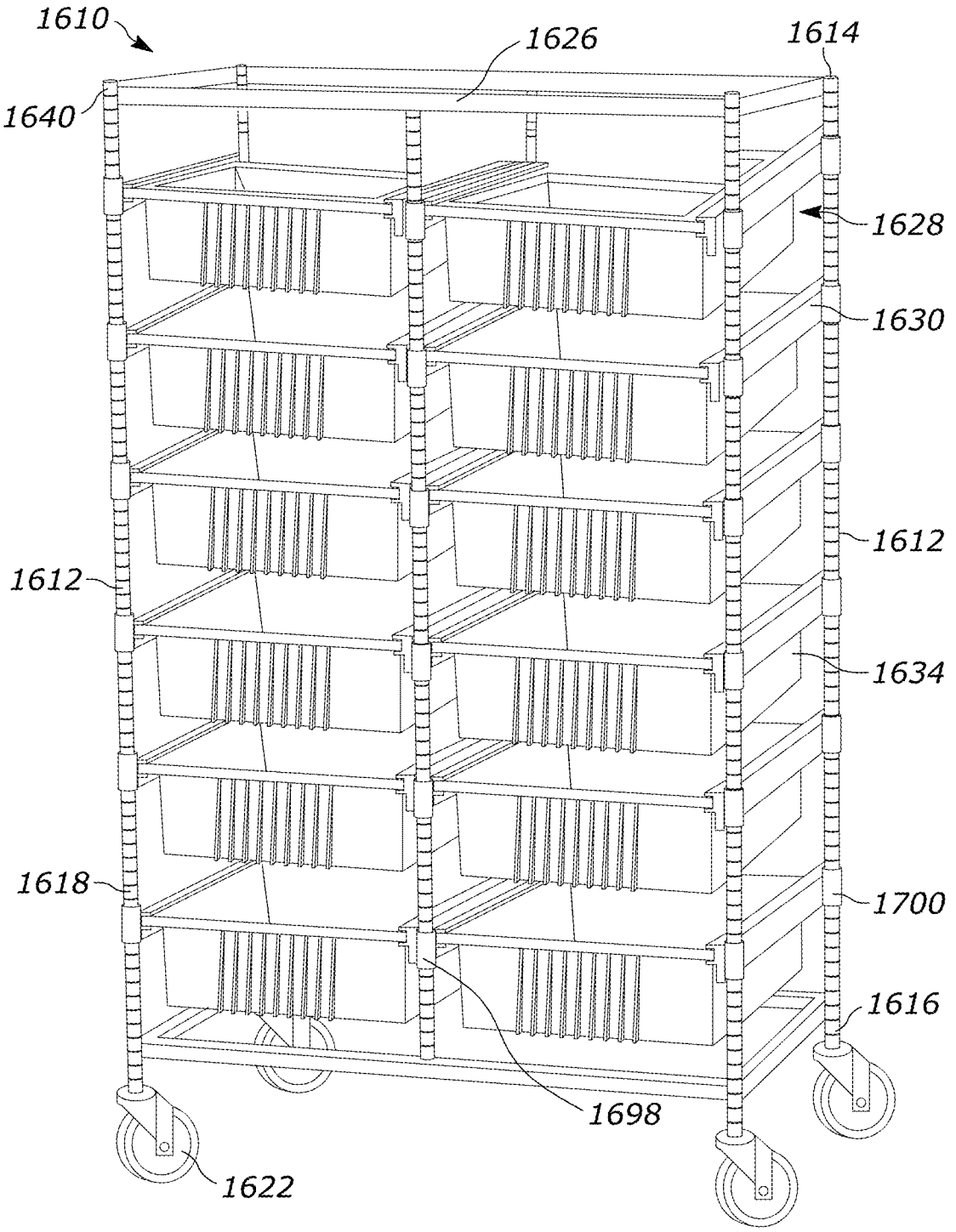
FIG. 22 is a perspective view of another shelving unit constructed in accordance with the present disclosure.
Figure 23:
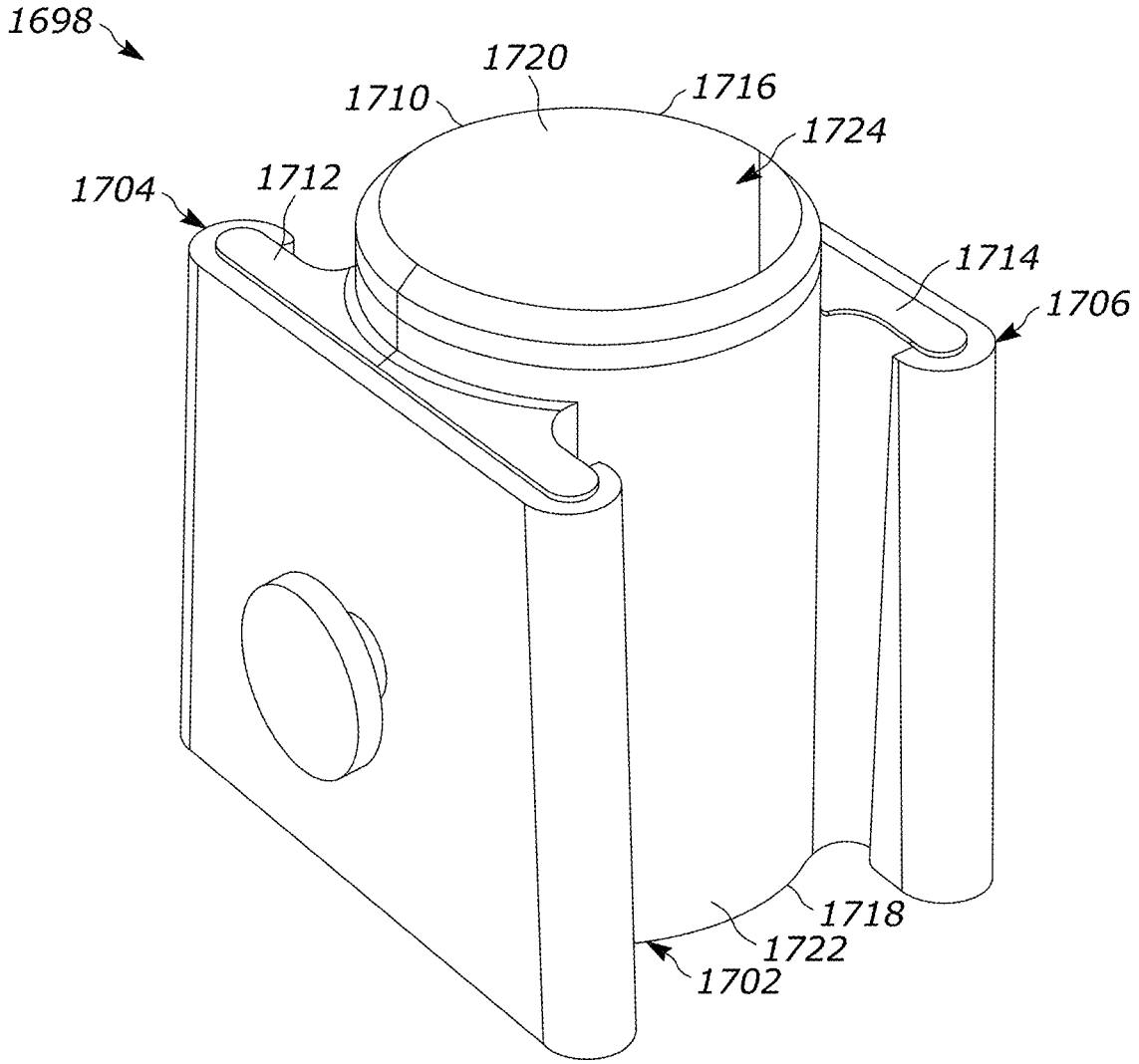
FIG. 23 is a perspective view of a shelf attachment device of the shelving unit shown in FIG. 20.
Figure 24:
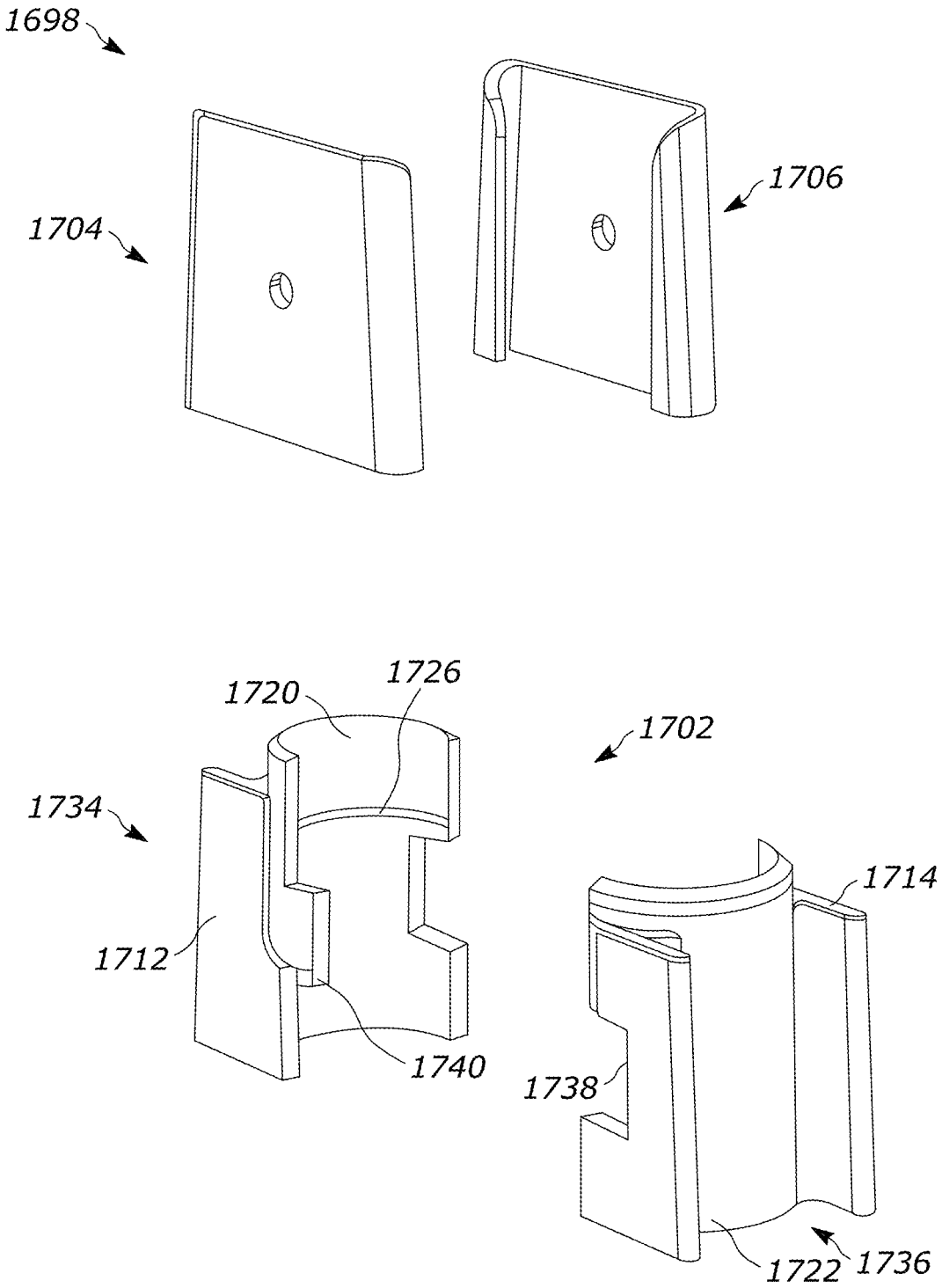
FIG. 24 is a partial exploded view of the shelf attachment device shown in FIG. 21.

With reference to FIGS. 22-24, another example shelving unit 1610 is provided in accordance with the present disclosure. The shelving unit 1610 includes a plurality of posts 1612. In the illustrated example, the plurality of posts 1612 includes six posts 1612. The six posts 1612 are arranged in three columns and two rows when viewed from above the shelving unit 1610. However, another suitable number of posts 1612 may be used and the plurality of posts 1612 may be arranged in another suitable configuration.

Each post 1612 extends between a first post end 1614 and a second post end 1616 that opposes the first post end 1614. Each post 1612 includes a plurality of circumferential grooves 1618 that are spaced apart between the first and second post ends 1614, 1616. A wheel 1622 may be disposed at the second post end 1616 of the posts 1612. For example, the wheel 1622 may be disposed at the four corner posts 1612, as illustrated. The wheels 1622 allow the shelving unit 1610 to move relative to a ground surface, for example, to transport the shelving unit 1610 to another location. Alternatively, a base (e.g., base 22) may be disposed at the second post end 1616 of the posts 1612 and the base may be adjustable to level the shelving unit 1610 relative to the ground surface.

The shelving unit 1610 may include one or more frames 1626 and one or more shelves 1628. The frames interconnect the posts 1612 using a plurality of receivers 1640 positioned at the corners of the frame 1626 or another suitable location of the frame 1626. The frame 1626 of the illustrated example includes four receivers 1640. However, another suitable number of receivers 40 may be provided. Each of the plurality of receivers 1640 receives one of the posts 1612. The receivers 1640 may have a cross-sectional shape and size to contour the cross-sectional shape and size of the posts 1612. The plurality of receivers 1640 are axially aligned with the respective posts 1612 and are movable along the respective post 1612 between the first post end 1614 and the second post end 1616. Each of the plurality of receivers 1640 of one frame 1626 may be positioned at the same or similar position along the respective posts 1612.

In the illustrated example, the shelving unit 1610 includes 12 shelves 1628 in total. However, the shelving unit 1610 may include another suitable number of shelves 1628. Each of the shelves 1628 include a set of siderails 1630. A first one of the siderails 1630 is coupled to two posts 1612 and a second one of the siderails 1630 is coupled to two posts 1612. The first and second ones of the siderails 1630 are positioned opposite to each other and in parallel. In one example, as illustrated, a basket 1634 may be engaged with the set of siderails 1630. In another example, a platform (e.g., shelf platform 1044) may be engaged with the set of siderails 1630. In yet another example, a sliding platform (e.g., sliding platform 1060) may be engaged with the set of siderails 1630.

The shelves 1628 are arranged such that two shelves 1628 are positioned beside each other. A first one of the second shelves 1628 is coupled to four posts 1612 and a second one of the second shelves 1628 is coupled to four posts 1612. Thus, the first and second ones of the second shelves 1628 are coupled to two of the same posts 1612. Each of the second shelves 1628 are attached to the posts 1612 using first attachment devices 1698 and second attachment devices 1700. The first shelf attachment device 1698 is configured to hold two shelves 1628 and the second shelf attachment device 1700 is configured to hold one shelf 1628. The second shelf attachment device 1700 may be the same or substantially similar to the shelf attachment devices 1100, 1300, 1500. Accordingly, the second shelf attachment device 1700 will not be re-described in detail.

As shown in FIGS. 23-24, the first shelf attachment device 1698 includes a collar 1702, a first lock plate 1704, and a second lock plate 1706. The first and second lock plates 1704, 1706 are the same or substantially similar. Furthermore, each of the first and second lock plates 1704, 1706 are the same or substantially similar to the lock plate 1104 of the shelf attachment device 1100. Therefore, the first and second lock plates 1704, 1706 will not be re-described in detail.

The collar 1702 includes a body 1710, a first pair of wing-like extensions 1712, and a second pair of wing-like extensions 1714. The body 1710 is shaped and sized to contour the cross-sectional shape and size of the post 1612. The body 1710 extends between a first body end 1716 and a second body end 1718 that opposes the first body end 1716. The body 1710 has an interior surface 1720 and an exterior surface 1722 that opposes the interior surface 1720. The interior surface 1720 defines an opening 1724 that extends between the first and second body ends 1716, 1718. An annular protrusion or rib 1726 extends from the interior surface 1720 and is positioned adjacent to the first body end 1716. The annular protrusion 1726 extends radially inward into the opening 1724 and extends annularly about the body 1710. The annular protrusion 1726 is shaped and sized to be positioned within one indent 1618 of the post 1612 in the slip-fit arrangement.

The first pair of wing-like extensions 1712 are the same or substantially similar to the first pair of wing-like extensions 512 of the shelf attachment device 498 and the second pair of wing-like extensions 1714 are the same or substantially similar to the second pair of wing-like extensions 514 of the shelf attachment device 498. Accordingly, the first and second pairs of wing-like extensions 1712, 1714 will not be re-described in detail.

In the illustrated example, the collar 1702 is split into a first half 1734 and a second half 1736 that can be separated to de-assemble the collar 1702 and can be interlocked together to assembly the collar 1702. Each of the first and second halves 1734, 1736 include approximately half of the body 1710, one of the first pair of wing-like extensions 1712, and one of the second pair of wing-like extensions 1714. Each of the first and second halves 1734, 1736 includes a recess 1738 and a protrusion 1740 that opposes the recess 1738. The protrusion 1740 is shaped, sized, and positioned to fit into the recess 1738. To assembly the collar 1702, the protrusion 1740 of the first half 1734 is pressed within the recess 1738 of the second half 1736. Likewise, the protrusion 1740 of the second half 1736 is pressed within the recess 1738 of the first half 1734. To de-assemble the collar 1702, the first and second halves 1734, 1736 are pulled apart from each other. In another example, a slit (e.g., slit 532) extends through the body 1710 such that the body 1710 is able to flex to an open position and return to a closed position.

The first lock plate 1704 is slidably engaged with the first pair of wing-like extensions 1712. The second lock plate 1706 is slidably engaged with the second pair of wing-like extensions 1714. The first one of the second shelves 1628 rests on the first lock plate 1704 of the first shelf attachment device 1698 and the second one of the second shelves 1628 rests on the second lock plate 1706 of the first shelf attachment device 1698.

Figure 25:
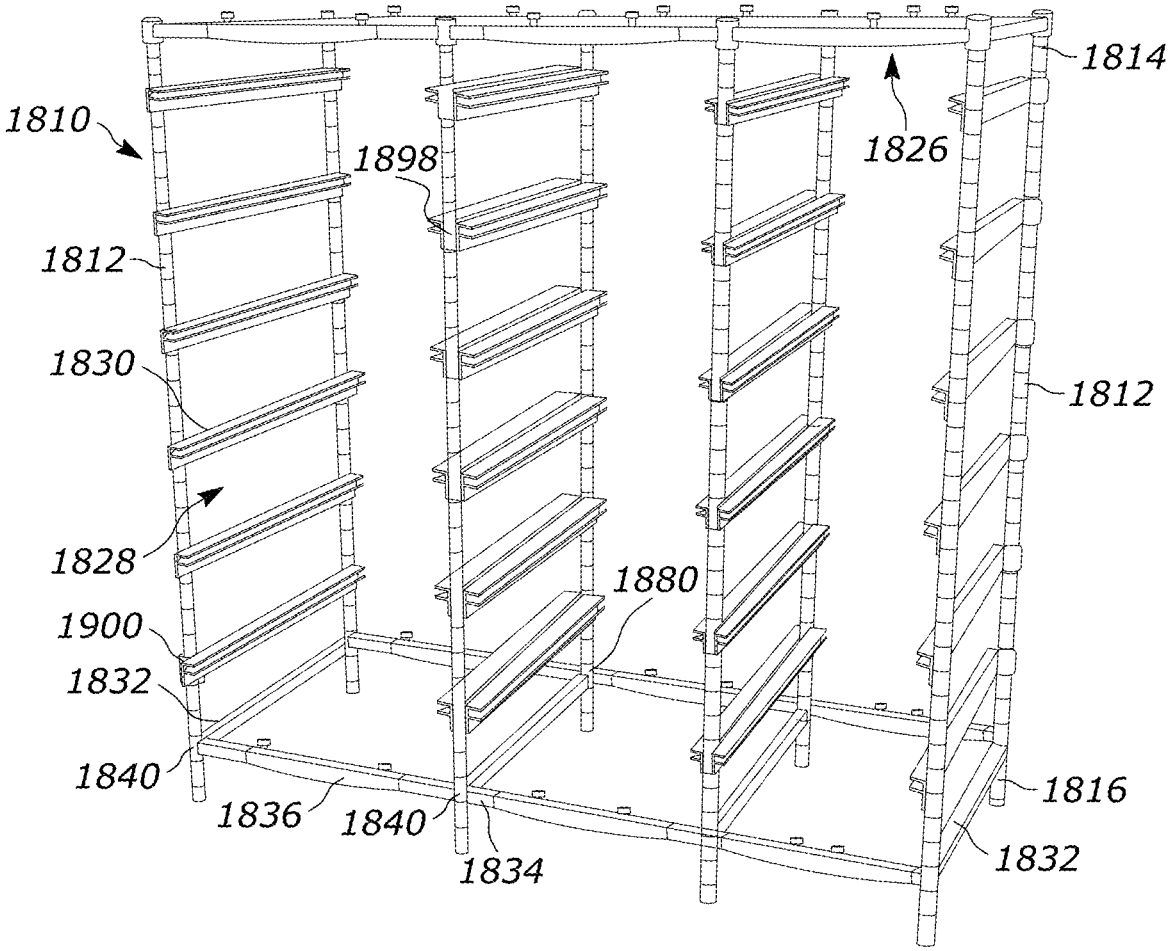
FIG. 25 is a perspective view of another shelving unit constructed in accordance with the present disclosure.

With reference to FIG. 25, yet another shelving unit 1810 is provided in accordance with the present disclosure. The shelving unit 1810 includes a plurality of posts 1812. The posts 1812 may be the same or substantially similar to the post 12 and thus, will not be re-described in detail. Each post 1812 extends between a first post end 1814 and a second post end 1816 that opposes the first post end 1814. In the illustrated example, the plurality of posts 1612 includes eight posts 1812. The eight posts 1812 are arranged in four columns and two rows when viewed from above the shelving unit 1810. However, another suitable number of posts 1812 may be used and the plurality of posts 1812 may be arranged in another suitable configuration.

The shelving unit may include one or more frames 1826 and one or more shelves 1828. The frames 1826 that interconnects the posts 1812 A first one of the frame 1826 may be disposed at the first post end 1814 and a second one of the frame 1826 may be disposed at the second post end 1816 of the posts 1812. The frame 1826 includes a set of first support beams 1832, one or more second support beams 1834, and a plurality of connecting beams 1836. The first support beam 1832 has a C-shaped profile and the second support beam 1834 has an I-shaped profile.

Each of the first and second support beams 1832, 1834 includes two receivers 1840 that are spaced apart from each other. The receivers 1840 are axially aligned with the posts 1812 such that the receivers 1840 are slidable along the posts 1812 to connect the frame 1826 to the posts 1812. In the illustrated example, each first support beam 1832 connects to two posts that are positioned at lateral ends of the shelving unit 1810. Each second support beam 1834 connect to two posts that are positioned between the lateral ends of the shelving unit 1810. Accordingly, the frame 1826 includes two first support beams 1832 and two second support beams 1834. However, the frame 1826 may include any suitable number of first and second support beams 1832, 1834. The connecting beam 1836 connects the first support beams 1832, the second support beams 1834, or a combination thereof.

Each of the shelves 1828 include a set of siderails 1830. A first one of the siderails 1830 is coupled to two posts 1812 and a second one of the siderails 1830 is coupled to two posts 1812. The first and second ones of the siderails 1830 are positioned opposite to each other and in parallel. In one example, a basket (e.g., basket 1034) may be engaged with the set of siderails 1830. In another example, a shelf platform (e.g., platform 1044) may be engaged with the set of siderails 1830. In yet another example, a sliding platform (e.g., sliding platform 1060) may be engaged with the set of siderails 1830.

The shelving unit 1810 may include three shelves 1828 positioned beside each other. A first one of the shelves 1828 is coupled to four posts 1812, a second one of the shelves 1828 is coupled to four posts 1812, and a third one of the shelves 1828 is coupled to four posts 1812. Thus, the first and second ones of the shelves 1828 are coupled to two of the same posts 1812 and the second and third ones of the shelves 1828 are coupled to two of the same posts 1812. Each of the shelves 1828 are attached to the posts 1812 using first shelf attachment devices 1898 and second shelf attachment devices 1900.

The first shelf attachment device 1898 is configured to hold two shelves 1828 and the second shelf attachment device 1900 is configured to hold one shelf 1828. The first shelf attachment device 1828 is the same or substantially similar to the first shelf attachment device 1898. The second shelf attachment device 1900 is the same or substantially similar to the shelf attachment device 1100, 1300, 1500. Accordingly, the first and second shelf attachment devices 1898, 1900 will not be re-described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shelving unit comprising:

a plurality of posts each extending between a first post end and a second post end that opposes the first post end;

a shelf including corner edges that are coupled to the plurality of posts and positioned between the first post end and the second post end; and a shelf attachment device formed as a separate component from the plurality of posts and the shelf, the shelf attachment device is attachable to one of the plurality of posts, and detachable from the one of the plurality of posts, the shelf attachment device comprising a ledge having a first wall, and a second wall that form an L-shaped support with one of the corner edges removably placed on the L-shaped support of the ledge, the shelf attachment device comprising;

a collar configured to extend around one of the plurality of posts when the shelf attachment device is attached to one of the plurality of posts, and a lock plate configured to slidably engage with the collar to secure the collar to the one of the plurality of posts, the lock plate including the L-shaped support that is configured to receive the one of the corner edges of the shelf.

2. The shelving unit of claim 1, further comprising a lock clip operable to couple the shelf to the shelf attachment device and inhibit separation of the shelf from the ledge.

3. The shelving unit of claim 1, wherein the collar includes a body that extends between a first body end and a second body end that opposes the first body end;

wherein the body includes a slit that extends between the first body end and the second body end; and wherein the body is made of a flexible material and movable between an open position and a closed position.

4. The shelving unit of claim 3, wherein the collar includes a pair of wing-like extensions that extend tangentially from the body.

5. The shelving unit of claim 4, wherein the pair of wing-like extensions are disposed on opposing sides of the slit and extend in opposing directions.

6. The shelving unit of claim 5, wherein:

movement of the pair of wing-like extensions in a direction toward each other places the collar in the closed position, and movement of the pair of wing-like extensions in a direction away from each other places the collar in the open position.

7. The shelving unit of claim 5, wherein the lock plate includes a pair of receivers that is slidably engaged with the pair of wing-like extensions of the collar.

8. The shelving unit of claim 1, wherein the lock plate includes the ledge.

9. The shelving unit of claim 1, wherein the collar includes the ledge.

* * * * *